US011877702B2

(12) United States Patent
Wexler et al.

(10) Patent No.: US 11,877,702 B2
(45) Date of Patent: Jan. 23, 2024

(54) ARTICLE ADVANCER

(71) Applicant: Medline Industries, LP, Northfield, IL (US)

(72) Inventors: Paige Wexler, Northfield, IL (US); Evan Oravec, Northfield, IL (US); Quinten Krisik, Northfield, IL (US); Gregory J Foster, Northfield, IL (US); Robert W. Sheldon, Northfield, IL (US)

(73) Assignee: Medline Industries, LP, Northfield, IL (US)

( * ) Notice: Subject to any disclaimer, the term of this patent is extended or adjusted under 35 U.S.C. 154(b) by 0 days.

(21) Appl. No.: 16/457,195

(22) Filed: Jun. 28, 2019

(65) Prior Publication Data

US 2020/0405103 A1 Dec. 31, 2020

(51) Int. Cl.
*A47K 10/42* (2006.01)

(52) U.S. Cl.
CPC ..... *A47K 10/422* (2013.01)

(58) Field of Classification Search
CPC ..... A47K 10/422; B65D 83/0817
See application file for complete search history.

(56) References Cited

U.S. PATENT DOCUMENTS 282,785 A * 8/1883 Schoof ..... A47K 10/424 221/45
953,953 A * 4/1910 Inglee ..... B65D 83/12 312/61
1,796,262 A * 3/1931 Gaisman ..... B65D 83/10 221/302
2,267,305 A 12/1941 Natwick
2,359,807 A * 10/1944 Testi ..... B26B 21/24 221/232
2,439,243 A * 4/1948 Dalkowitz ..... B65D 83/10 206/355
2,634,855 A * 4/1953 Mandel ..... B65D 83/0817 221/59
2,655,257 A * 10/1953 Testi ..... B65D 83/10 206/357

(Continued)

FOREIGN PATENT DOCUMENTS

CN 2835145 Y 11/2006
DE 20316963 U1 3/2005

(Continued)

OTHER PUBLICATIONS

Design U.S. Appl. No. 29/696,646, filed Jun. 28, 2019, entitled "Compressible Article Advancer".

(Continued)

*Primary Examiner* — Gene O Crawford
*Assistant Examiner* — Kelvin L Randall, Jr.
(74) *Attorney, Agent, or Firm* — Fitch, Even, Tabin & Flannery LLP

(57) ABSTRACT

An article advancing assembly and various article advancers are provided for helping dispense articles from a container. In some forms, the article advancers are provided that can bias the contents of the containers towards the dispensing opening. This can, in some forms, provide extra friction within the container and/or at the dispensing opening to decrease extra contents from being dispensed and thus decrease waste.

6 Claims, 34 Drawing Sheets

(56) References Cited

U.S. PATENT DOCUMENTS 2,674,368 A * 4/1954 Bailey ..... B65D 83/10 221/232
2,726,787 A * 12/1955 Nelson ..... B65D 83/10 221/229
3,375,956 A * 4/1968 Katz ..... A47K 10/44 221/259
3,595,661 A * 7/1971 Nicholas ..... G03B 17/34 396/360
3,705,542 A * 12/1972 Gold ..... G03B 17/52 396/366
3,942,682 A * 3/1976 McKay ..... A47K 10/422 221/58
4,240,564 A * 12/1980 Pritchard ..... B65D 83/087 221/232
4,997,105 A * 3/1991 Fischer ..... B65D 5/16 206/278
D330,902 S 11/1992 Siden
5,161,702 A 11/1992 Skalski
5,197,631 A 3/1993 Mishima
D338,440 S 8/1993 Rafferty
5,363,985 A * 11/1994 Cornell ..... B42D 5/005 221/56
D404,953 S 2/1999 Fransson
5,921,434 A 7/1999 Hollander
5,954,226 A * 9/1999 Peterson ..... A47F 1/06 221/59
5,979,700 A * 11/1999 Suess ..... B65D 83/0817 221/52
5,992,683 A 11/1999 Sigl
7,063,233 B2 6/2006 Jordan
D569,467 S 5/2008 Wake
7,699,189 B2 4/2010 Tramontina
D650,210 S 12/2011 Spoljaric
D681,144 S 4/2013 Azadi
8,523,011 B2 * 9/2013 Haas ..... B65D 83/0418 221/229
8,646,653 B2 2/2014 Lien
D809,375 S 2/2018 Wyser
D876,857 S 3/2020 Martin
2002/0108962 A1 * 8/2002 Mangin ..... A47K 10/42 221/63
2003/0168468 A1 * 9/2003 Thompson ..... B65D 83/0817 221/56
2004/0164086 A1 8/2004 Thompson
2005/0077314 A1 * 4/2005 Boykin ..... A47F 1/123 221/307
2006/0060599 A1 * 3/2006 Zychinski ..... A47K 10/422 221/52
2009/0277920 A1 * 11/2009 Cittadino ..... A47K 10/422 221/1
2011/0011879 A1 * 1/2011 Johnson ..... A47K 10/422 221/45
2012/0199602 A1 * 8/2012 Jordan ..... A61B 42/40 221/37
2013/0186800 A1 7/2013 Lien
2018/0105348 A1 * 4/2018 Modha ..... B65D 83/0817
2018/0111744 A1 4/2018 Modha
2018/0111745 A1 4/2018 Modha

FOREIGN PATENT DOCUMENTS

DE 102004015576 A1 11/2005
DE 102005056162 A1 7/2007
GB 2503677 A 1/2014
JP 3011228 U 5/1995
JP H11206614 A 8/1999
JP 2011020706 A * 2/2011
JP 2011020706 A 2/2011
NL 6703027 A 5/1968

OTHER PUBLICATIONS

Eco Pull* Dispenser System; Halyard Health, Inc. product brochure; publicly available at least May 2017; 2 pages.
PCT Search Report and Written Opinion from corresponding International Application No. PCT/US2020/035853 dated Sep. 4, 2020; 12 pages.

* cited by examiner

ARTICLE ADVANCER

FIELD OF THE INVENTION

The present application relates to article advancers and article advancing assemblies, and more particularly to article advancing assemblies for dispensing gloves from a container.

BACKGROUND OF THE INVENTION

A variety of articles are dispensed from containers whereby the articles are stacked or otherwise compressed together to maximize the use of space in the container. However, when the articles are dispensed, oftentimes extra articles may be dispensed when they are not needed, thereby creating waste. For example, with one-time use articles, such as disposable gloves, only one or two gloves may be desired at a time. However, oftentimes multiple gloves are accidentally dispensed that may not otherwise be needed.

This problem can be exacerbated as the contents are dispensed and the container becomes less full. In this regard, as more empty space is created in the container, there may be less friction between the contents of the container and the container walls. For example, with a half full box of disposable gloves, there is oftentimes empty space between the gloves and the top wall of the container adjacent the dispensing opening. As gloves are removed from the opening, it becomes more likely that unwanted extra gloves may also be dispensed as there is less friction to retain the extra gloves in the container. This problem can become especially troublesome near the end of the box of gloves as large clumps of gloves may become stuck together thereby dispensing significantly more gloves than desired.

When certain types of extra articles are accidentally dispensed, they may need to be disposed of. For example, medical items, such as medical gloves, masks, and other products could be considered "contaminated" if they are accidentally dispensed and not immediately used. Glove boxes may also be wall mounted such that if extra gloves are accidentally dispensed, they may fall to the ground and immediately become contaminated.

SUMMARY OF THE INVENTION

In view of the above issues, a variety of different article advancers and article advancing systems have been developed. In some forms, the article advancers are provided that can bias the contents of the containers towards the dispensing opening. This can, in some forms, provide extra friction within the container and/or at the dispensing opening to decrease extra contents from being dispensed and thus decrease waste.

According to one form, an article advancer assembly is provided that includes a container and an article advancer. The container defines an interior chamber and a dispensing opening for providing access to the interior chamber. The article advancer is positioned in the interior chamber and is configured to bias contents of the container towards the dispensing opening. The article advancer has an arcuate body with at least one first side leg extending from a first side of the body and at least one second side leg extending from a second side of the body opposite the first side. The article advancer is movable between a compressed configuration and a fully dispensed configuration. When in the compressed configuration, a plane extending tangent to an uppermost portion of the arcuate body is positioned a first distance from a distal end of each of the at least one first side leg and at least one second side leg. When in the fully dispensed configuration, the plane extending tangent to the uppermost portion of the arcuate body is positioned a second distance from the distal end of each of the at least one first side leg and at least one second side leg, the second distance being greater than the first distance. At least one of the arcuate body, the at least one first side leg, and the at least one second side leg providing a biasing force from the compressed configuration to the fully dispensed configuration.

In accordance with one form, the article advancing assembly further includes two first side legs and two second side legs.

In one form, the arcuate body, the at least one first side leg, and the at least one second side leg are integral.

According to one form, at least a portion of the article advancer comprises acrylonitrile butadiene styrene, polyoxymethylene, nylon, polypropylene, polyethylene terephthalate, or combinations thereof.

In accordance with one form, the article advancer has a thickness in a range of 1 to 3 mm.

In one form, the article advancing assembly further includes a biasing structure extending between the at least one first side leg and the at least one second side leg.

According to one form, the distal ends of each of the at least one first side leg and at least one second side leg includes a foot portion.

In accordance with one form, the article advancing assembly further includes a platform positioned between the article advancer and the dispensing opening, the platform configured to support the contents of the container above the article advancer.

In one form, the container is a box, a bag, or combinations thereof.

According to one form, the at least one first side leg and the at least one second side leg are generally planar.

These and other aspects may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Referring to the attached figures and below description, various forms of article advancers and article advancing assemblies are provided and described. Some structures shown in the figures are depicted as being generally transparent so the underlying structures are easier to view and understand. It should be appreciated that these structures may or may not be transparent but are simply depicted in this manner to easily see the interior structures.

Containers having dispensing openings are also provided herein and may be described as having the dispensing openings positioned towards a top surface of the container. It should be understood that the containers may be positioned in a variety of orientations such that the top surface may not be the vertical top surface. For example, if a container is mounted to a wall, the top surface may actually be oriented with the top surface on the side. Further, the shape, size, orientation, and other features of the dispensing opening can be modified as desired, such as depending on the materials being dispensed. Further, in many of the figures, the dispensing openings are not shown to keep the figures easier to understand and otherwise not interfere in the representation of the structures within the containers. However, it should be appreciated that the containers should be interpreted as including a dispensing opening.

Figure 1:
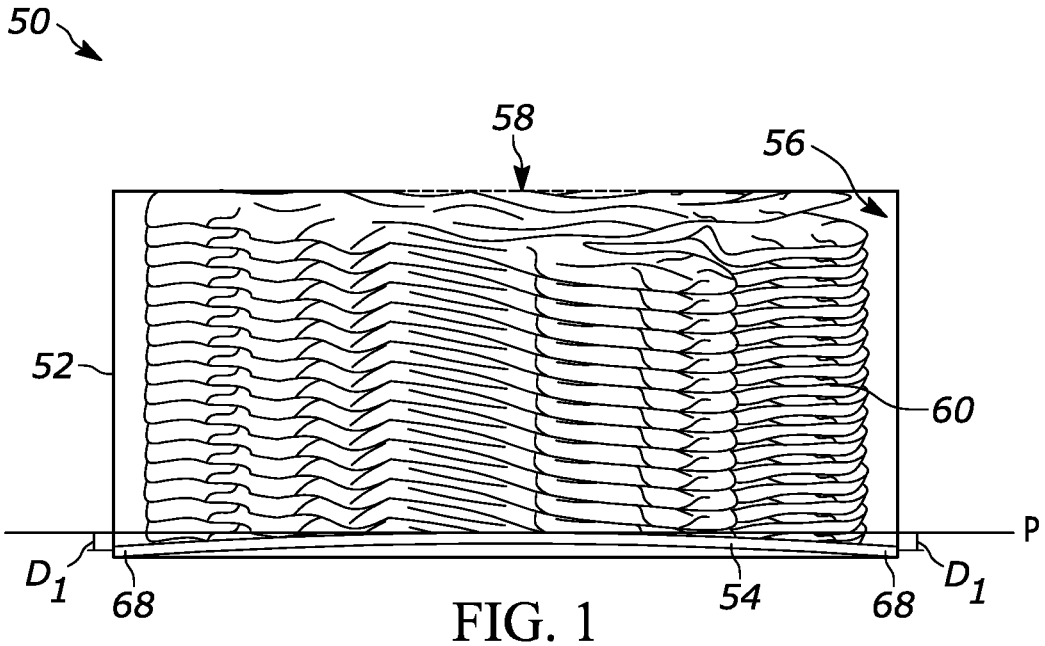
FIG. 1 is a side cross-sectional view of an article dispensing assembly.
Figure 2:
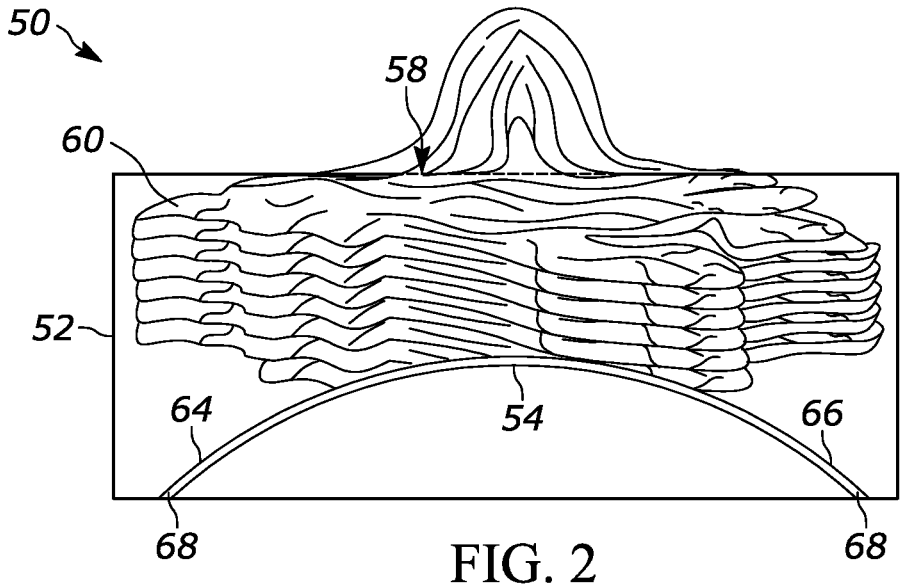
FIG. 2 is a side cross-sectional view of the article dispensing assembly of FIG. 1 in a dispensing condition.
Figure 3:
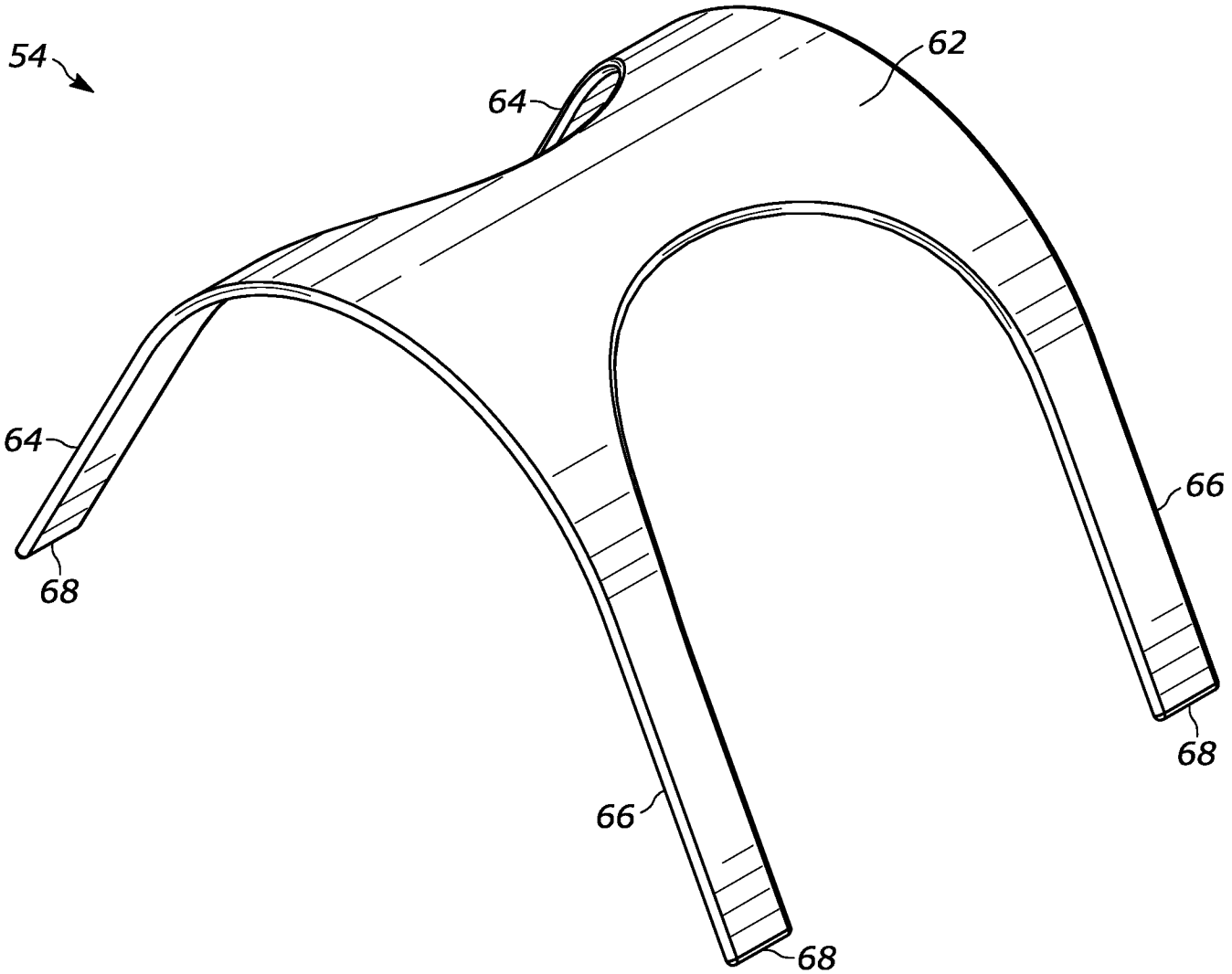
FIG. 3 is a perspective view of an article advancer.
Figure 4:
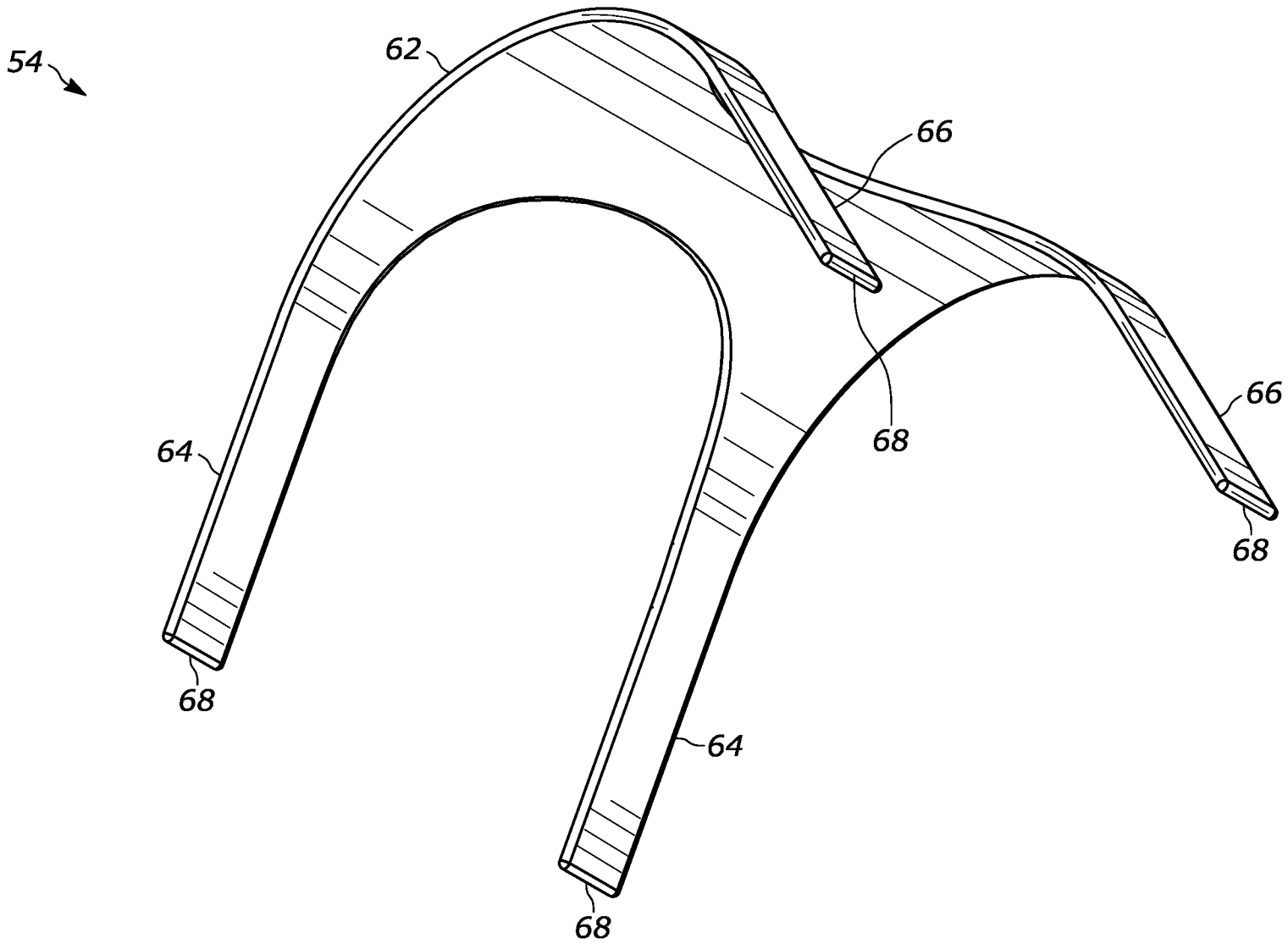
FIG. 4 is a bottom perspective view of the article advancer of FIG. 3.
Figure 5:
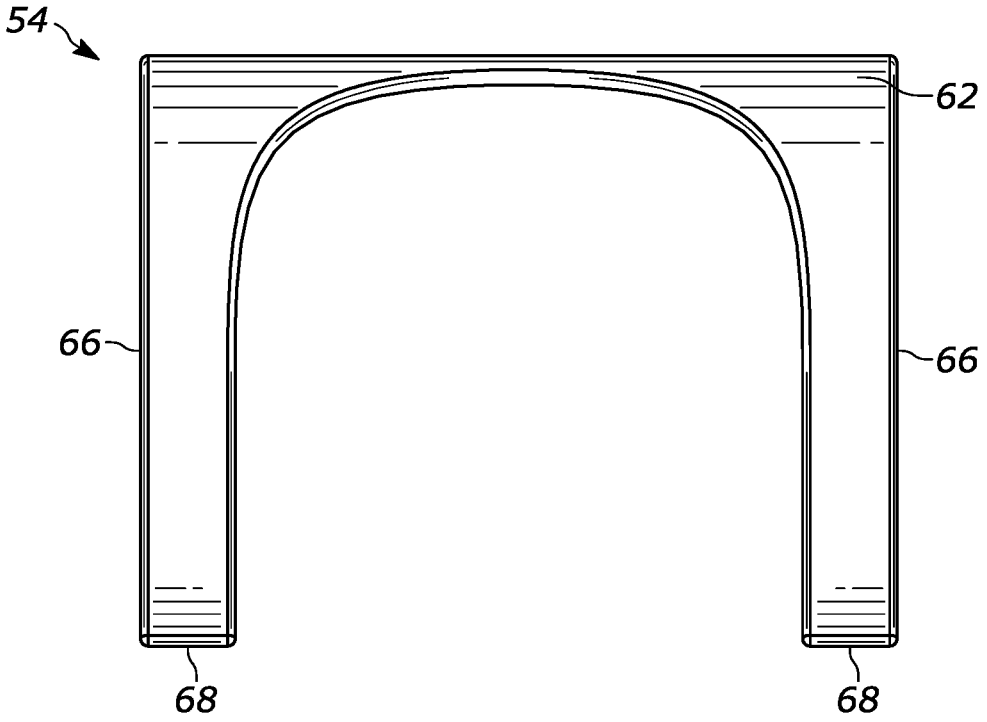
FIG. 5 is a right side view of the article advancer of FIG. 3.
Figure 6:
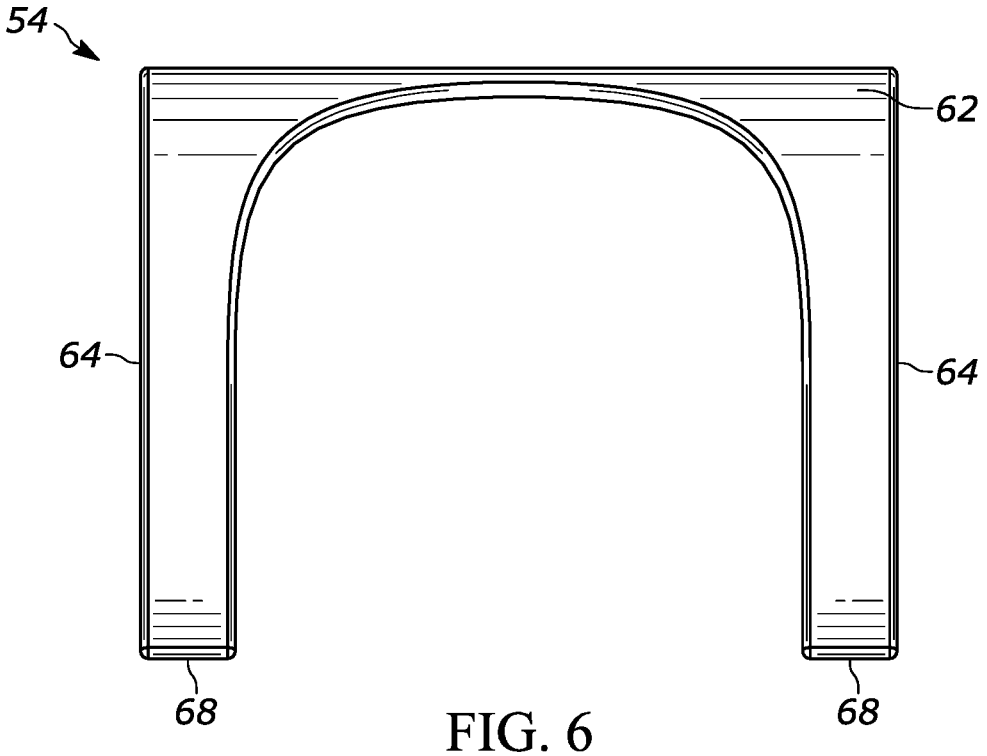
FIG. 6 is a left side view of the article advancer of FIG. 3.
Figure 7:
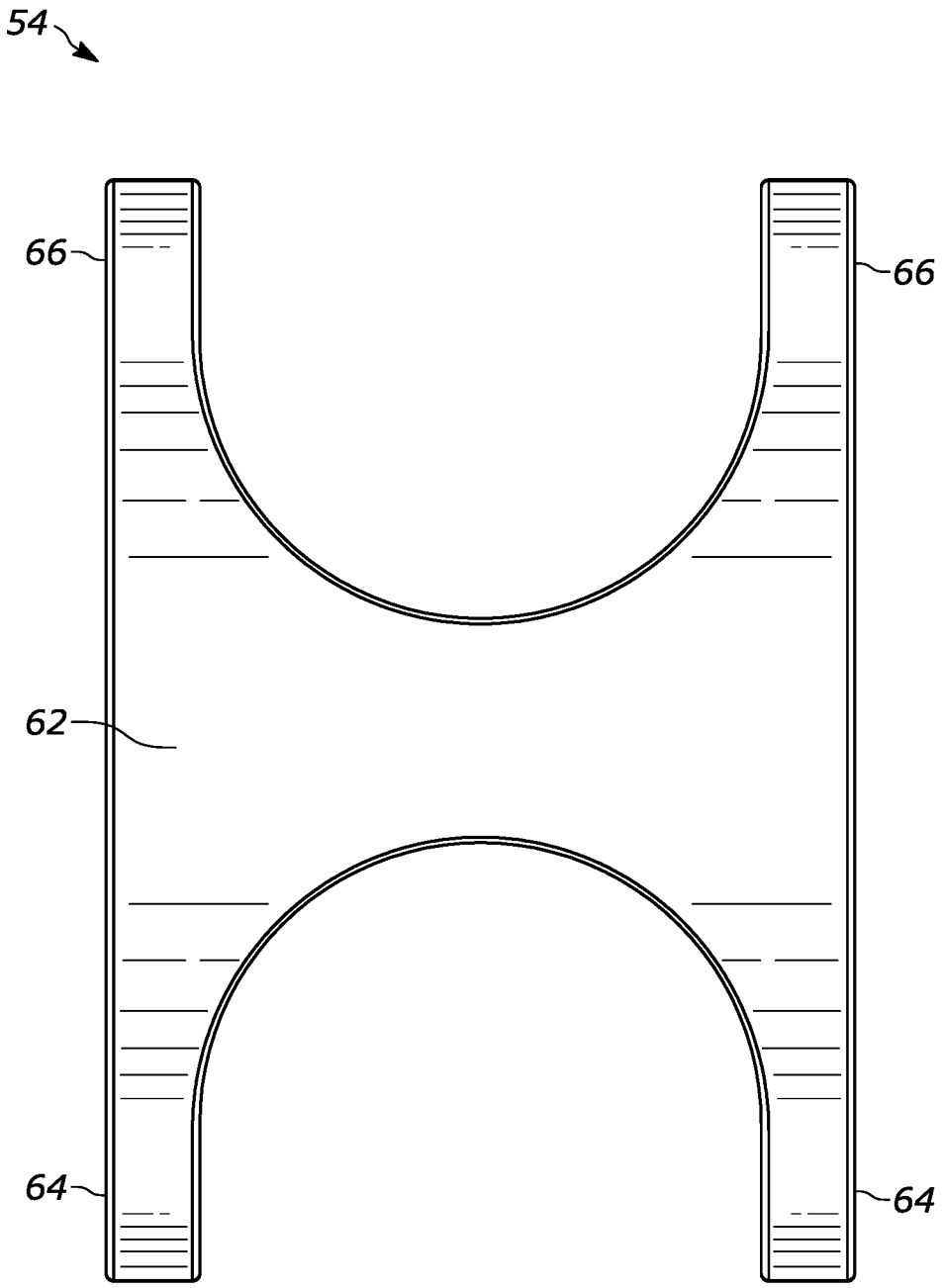
FIG. 7 is a top view of the article advancer of FIG. 3.
Figure 8:
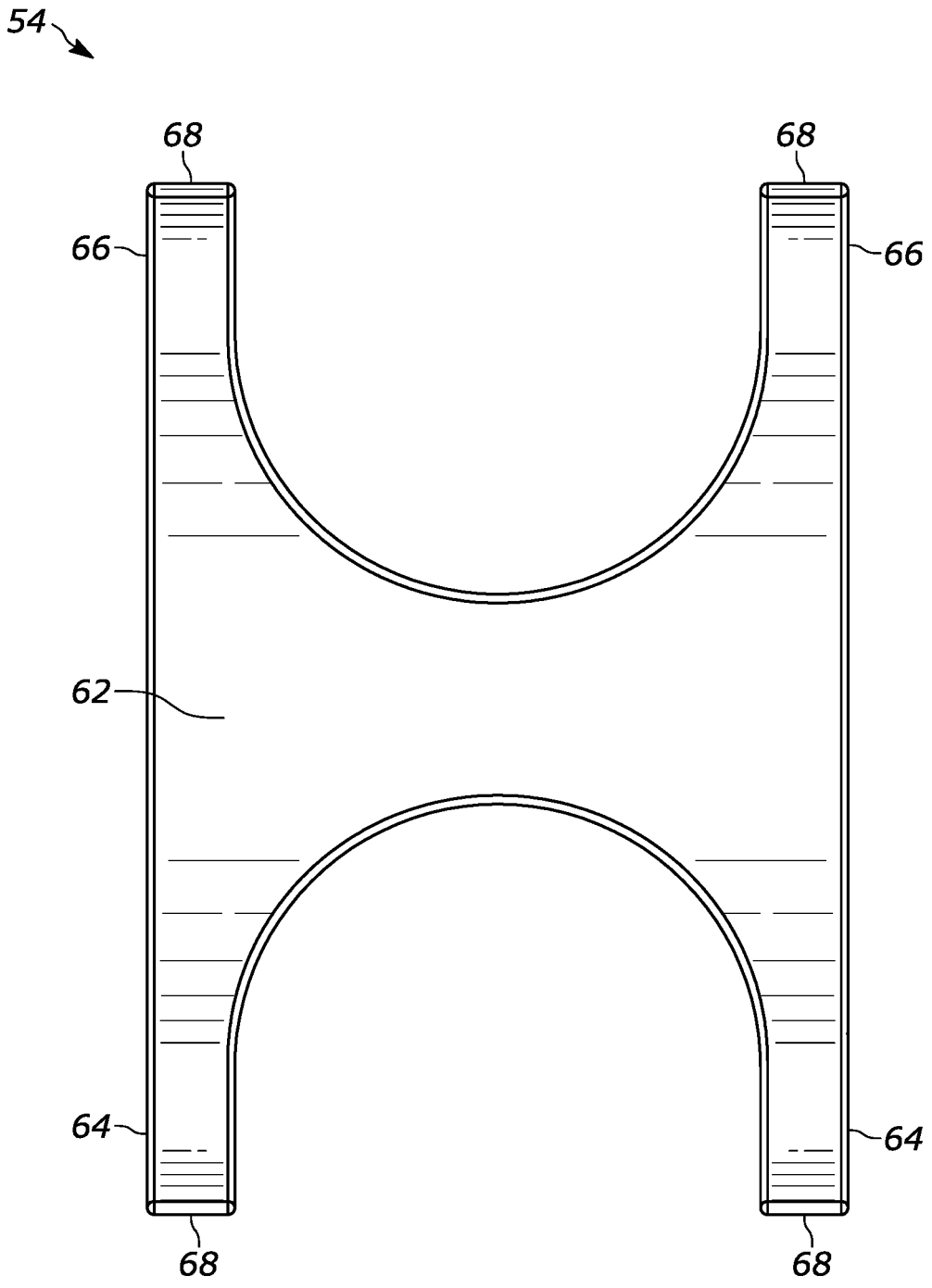
FIG. 8 is a bottom view of the article advancer of FIG. 3.

Referring to FIGS. 1 and 2, an article advancing assembly 50 is shown including a container 52 and an article advancer 54 positioned in an interior chamber 56 of the container 52. The container further includes a dispensing opening 58 (shown in dashed lines) for providing a user access to the interior chamber 56. Also shown in FIGS. 1 and 2 are items to be dispensed from the container 52, such as gloves 60. It should be appreciated that while gloves 60 are shown as being dispensed from the container 52, other items may also be dispensed.

The container 52 may take a variety of forms and may be rigid, flexible, a combination of rigid and flexible surfaces, and the like. While illustrated in the figures as generally being a rigid box, such as a cardboard box, the container 52 may take a variety of other forms, such as a bag, a combination box and bag, as well as other forms.

Referring now to FIGS. 3-9, the article advancer 54 is shown in more detail and separated from the container 52. The article advancer 54 generally includes a body 62, at least one first side leg 64, and at least one second side leg 66 opposite the first side. In one form, the body 62 is generally arcuate which can be a constant radius, an increasing radius, a decreasing radius, a variable radius, and the like. One form of the arcuate structure of the body 62 can be seen in FIG. 9. Further, in some forms, the at least one first and second side legs 64,66 may generally be planar.

As found in FIGS. 3-9, the article advancer 54 includes two first side legs 64 and two second side legs 66. It should be appreciated that the article advancer 54 can include any number of side legs and may include an uneven number on the first side compared to the second side. Each of the side legs 64,66 generally includes an end 68. The end may take a variety of forms including but not limited to flanges or feet, such as will be described in other embodiments herein.

The article advancer 54 is generally movable between a compressed configuration and a fully dispensed configuration. The compressed configuration is generally shown in FIG. 1 whereby the article advancer 54 is moved towards a generally flat position. It should be understood that the compressed configuration need not be flat, but that the article advancer 54 is compressed in some manner such that it provides a biasing force to move away from the compressed configuration. In the compressed configuration, a plane P is positioned a first distance D1 from an end 8 of each of the first side leg 64 and second side leg 66. Generally, in the compressed configuration, the contents of the container 52 alone or in combination with the inner surfaces of the container 52 will maintain the article advancer 54 in the compressed configuration.

As the contents of the container 52 are removed, the article advancer moves from the compressed configuration towards the fully dispensed configuration. FIG. 2 shows that some of the gloves 60 have been removed from the container 52 such that the article advancer 54 is moving from the compressed configuration towards a fully dispensed configuration. Comparing FIG. 2 to FIG. 1, as the article advancer 54 moves towards the fully dispensed configuration, the ends 68 of the first and second side legs 64,66 move closer towards one another.

Figure 9:
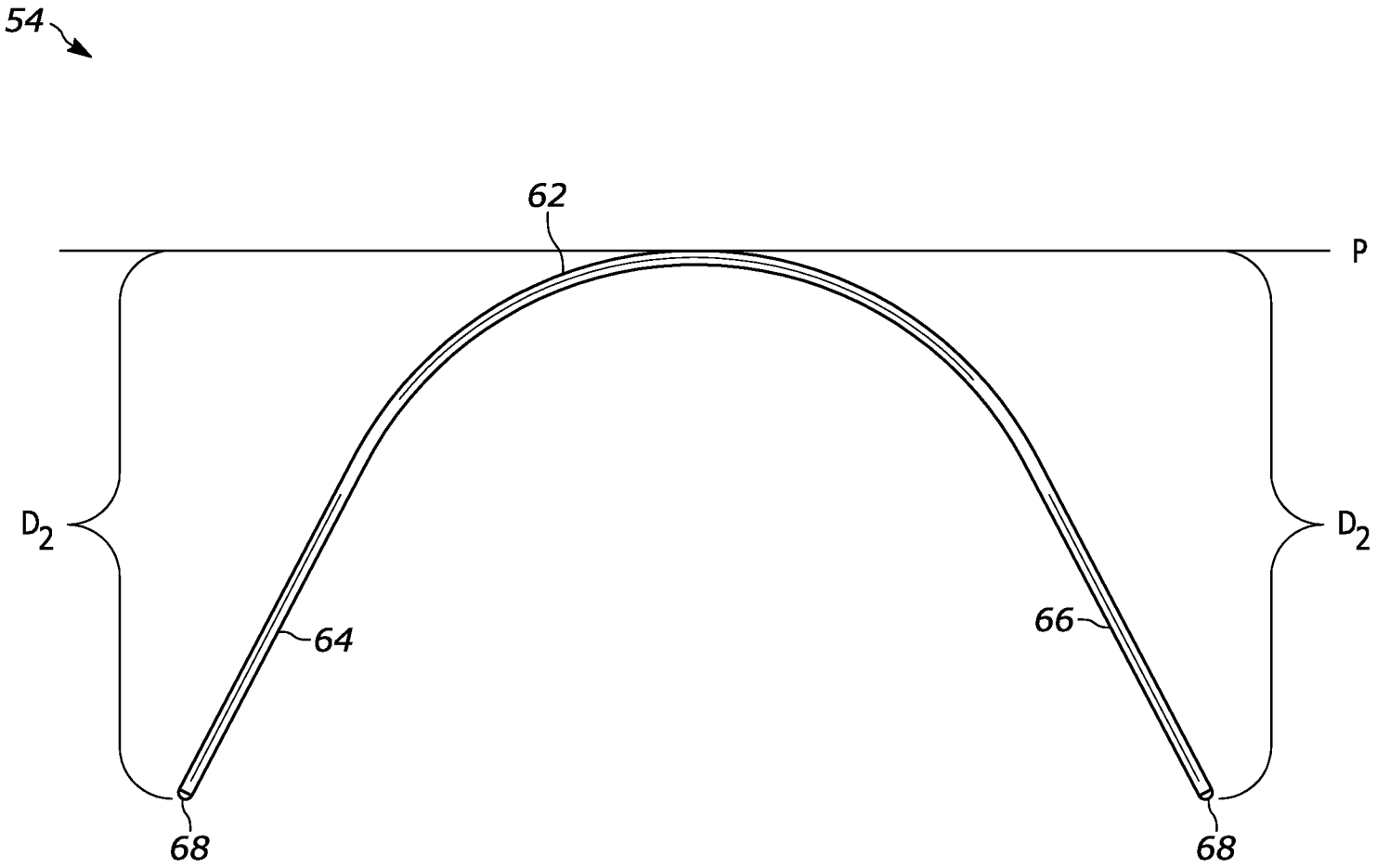
FIG. 9 is a front view of the article advancer of FIG. 3.

One form of the fully dispensed configuration for the article advancer 54 is shown in FIG. 9. As seen in this figure, the plane P is now positioned a second distance D2 from the ends 68. The second distance D2 is greater than the first distance D1. As shown in FIG. 9, the article advancer 54 may generally be in a natural, unbiased state when in the fully dispensed configuration. However, in some forms, the article advancer 54 may still be in a biased state when in the fully dispensed configuration. For example, if the article advancer 54 has a height which is taller than the interior of the container 52, the container 52 may still prevent the article advancer 54 from being in an unbiased state.

At least one of the body 62, the at least one first side leg 64, and the at least one second side leg 66 provide a biasing force for the article advancer 54. For example, at least one of the body 62, the at least one first side leg 64, and the at least one second side leg 66 may be manufactured from a material that has elastic properties whereby the material flexes when moving towards the compressed configuration thereby creating a biasing force. In some forms, each of the body 62, the at least one first side leg 64, and the at least one second side leg 66 may be manufactured from a material that has elastic properties such that each structure provides at least some biasing force when in the compressed configuration. Further, the body 62, the at least one first side leg 64, and the at least one second side leg 66 may be integral and formed from the same material.

As noted above, the article advancer 54 provides a biasing force when moving from the compressed configuration towards the fully dispensed configuration. The biasing force can be used to move the contents of the container 52 towards the dispensing opening 58. Further, the biasing force may help compress the contents of the container 52 and increase friction between the contents of the container 52, such as at an upper portion adjacent the dispensing opening 58. As shown in FIG. 2, depending on the contents of the container 54, the contents may generally maintain the shape of the container 54. The gloves 60 may be tightly compressed when installed in the container such that they generally maintain a somewhat rigid, compact structure for at least a portion of the time the article advancer 54 moves towards the fully dispensed configuration.

In one form, the biasing force from the article advancer 54 is linear and provides generally the same force from the compressed configuration up until the fully dispensed configuration. In another form, the biasing force may vary as the article advancer 54 moves towards the fully dispensed configuration.

Additional embodiments of article advancers and article advancing assemblies are provided below. Many of these embodiments include the same and/or similar structures as shown in FIGS. 1-9 such that the structures are not discussed below in detail.

Figure 10:
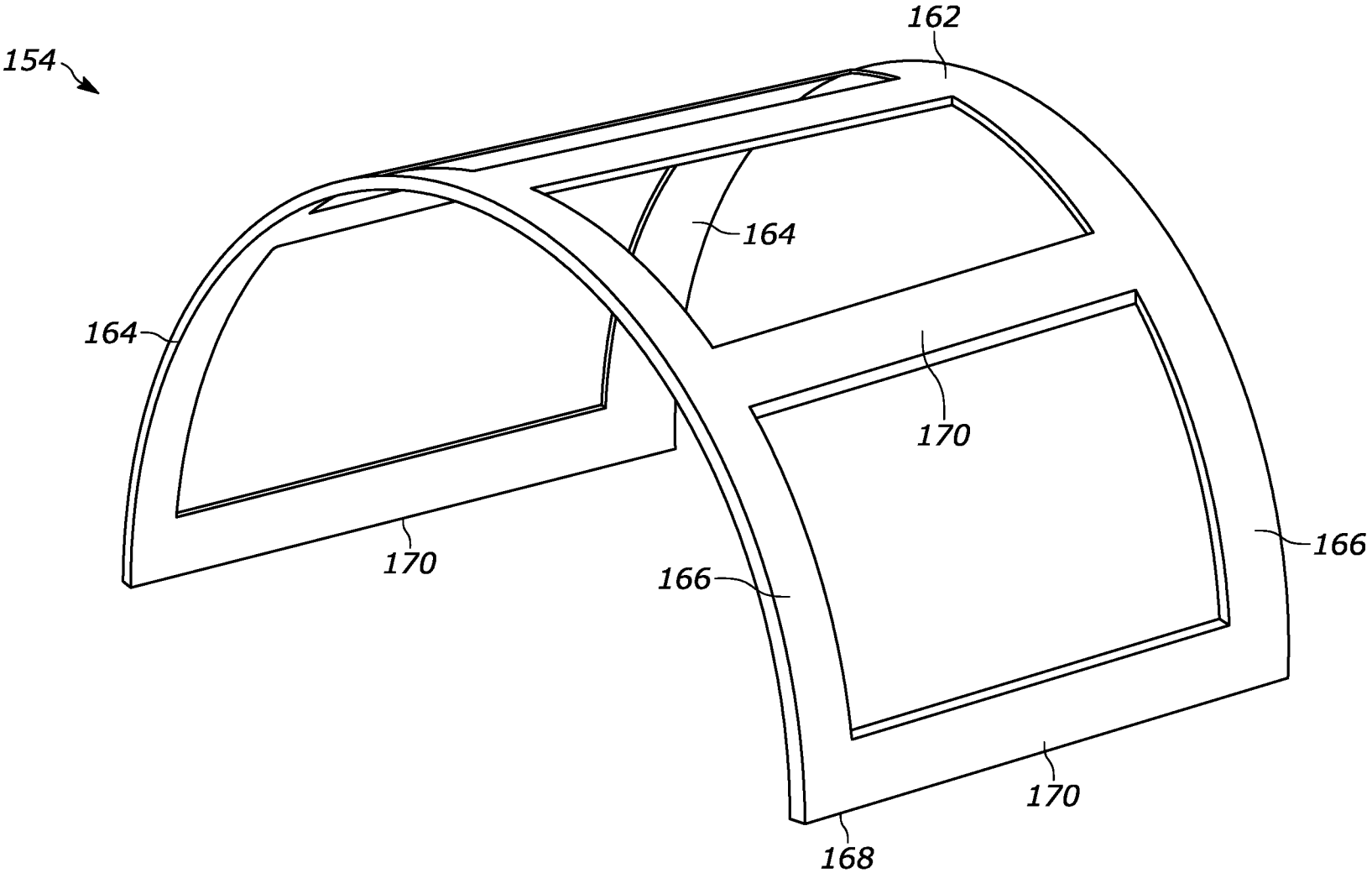
FIG. 10 is a perspective view of another article advancer.

Referring to FIG. 10, an article advancer 154 is shown having an arcuate body 162, at least one first side leg 164, and at least one second side leg 166. The article advancer 154 also includes a plurality of support ribs 170. The support ribs extend between opposite sides of the article advancer 154. In one form, some of the support ribs 170 form ends 168. It should be appreciated that the ribs 170 may provide further stability to the article advancer 154 and/or between the respective legs 164,166. The article advancer 154 functions in a similar manner as article advancer 54 whereby article advancer 154 provides a biasing force when in a compressed configuration and moves towards a fully dispensed configuration. Further, the ends 170 move towards one another when moving from the compressed configuration to the fully dispensed configuration.

Figure 11:
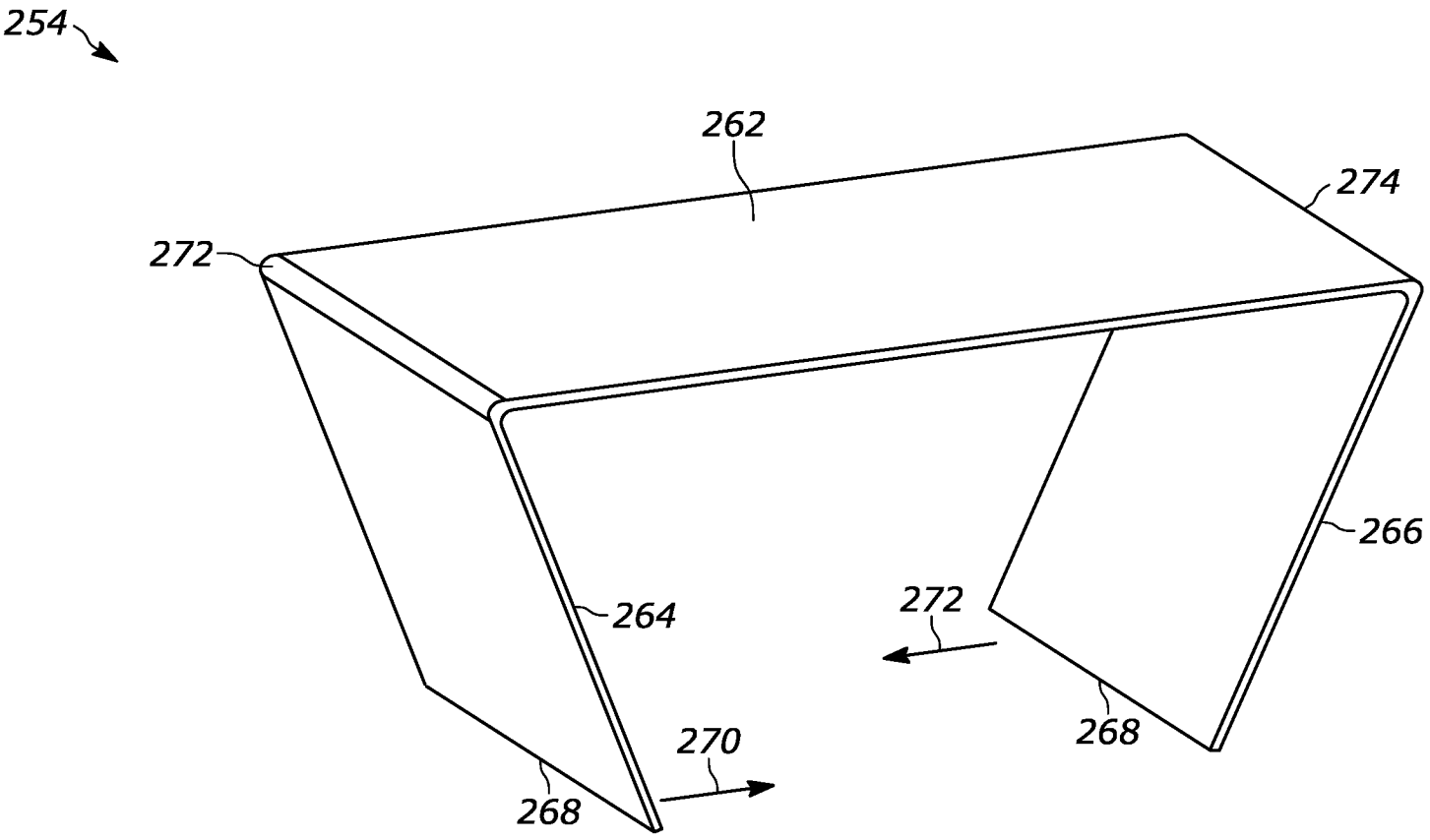
FIG. 11 is a perspective view of another article advancer.

Article advancer 254 is shown in FIG. 11 which includes similar structure as article advancer 54, but the structure functions somewhat differently. More specifically, article advancer 254 includes a body 262, which is not arcuate, a first side leg 264, and a second side leg 266. As shown in FIG. 11, the first and second side legs 264,266 extend towards each other in both the compressed configuration and the fully dispensed configuration. When moving towards the compressed configuration, the legs 264,266 move towards one another, as shown by arrows 268,270. As the article advancer 264 moves from the compressed configuration towards the fully dispensed configuration, the legs 264,266 move away from one another, but still extend in directions towards one another. Article advancer 254 generally provides a biasing force primarily from the elasticity at the connections 272,274 between the body 262 and the respective legs 264,266. In some forms, further biasing force may be provided by the elasticity of one or more of the body 262, first side leg 264, and second side leg 266.

Figure 12:
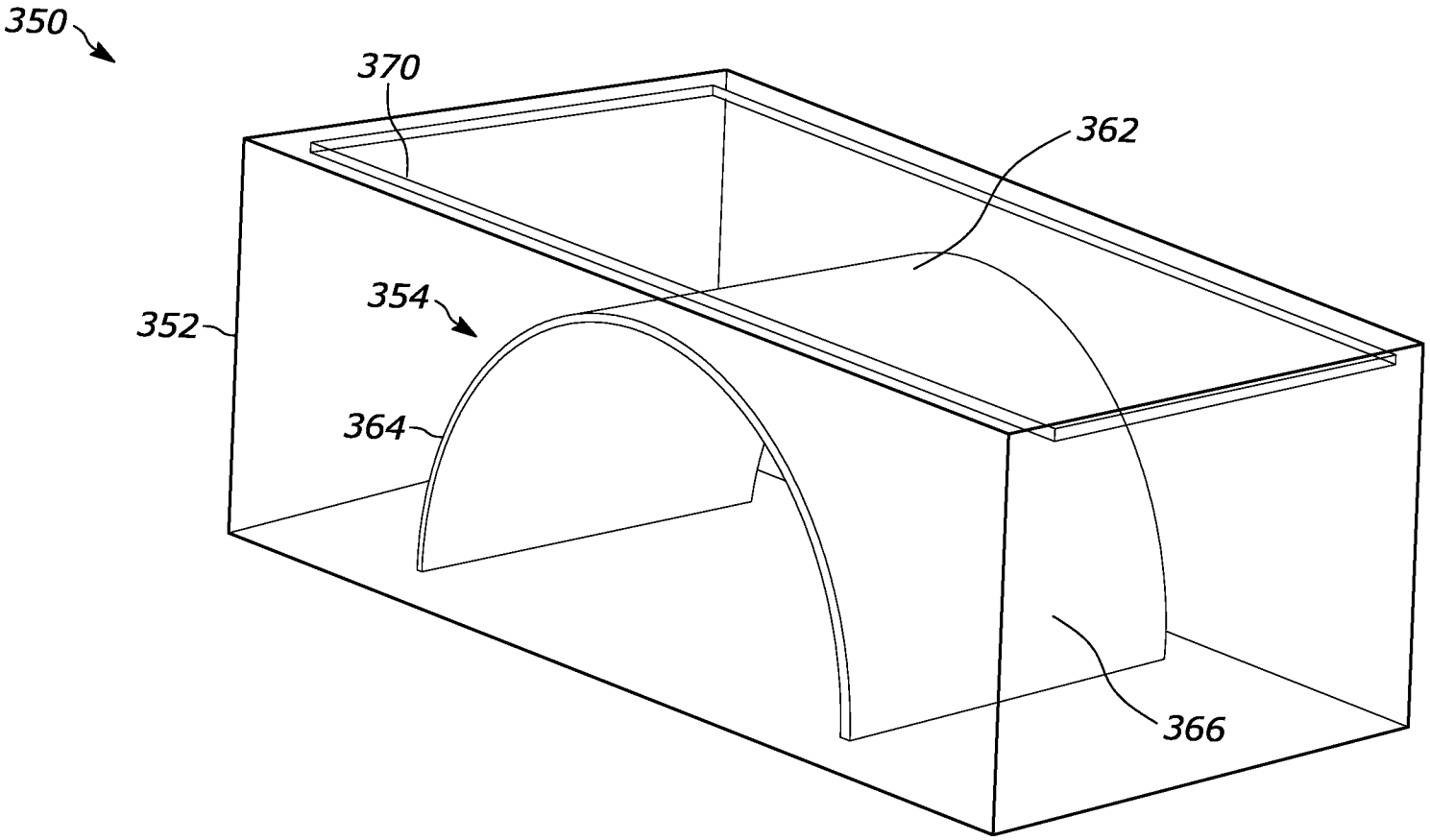
FIG. 12 is a perspective view of an article dispensing assembly including a lifting platform where the container and lifting platform are shown as transparent.

FIG. 12 shows an article advancing assembly 350 which includes an article advancer 354 in a container 352. The dispensing opening for the container is not shown. The article advancer 354 is similar to article advancer 54 and includes an arcuate body 362, a first side leg 364, and a second side leg. The article advancer 354 biases and moves between the compressed configuration and fully dispensed configuration in a similar manner as article advancer 54. The article advancer 354 is generally shown in FIG. 12 in a fully dispensed configuration. The article advancing assembly 350 also includes a platform 370 positioned above the article advancer 354. The platform 370 can be used to help maintain the contents of the container 352 above the article advancer 354, prevent binding of the contents when moving between the compressed configuration and fully dispensed configuration, and/or otherwise provide a steady platform to ensure that the contents are adequately lifted. It should be appreciated that the platform 370 can be used with other article advancers described herein and should not be limited to the assembly 350 shown in FIG. 12.

Figure 13:
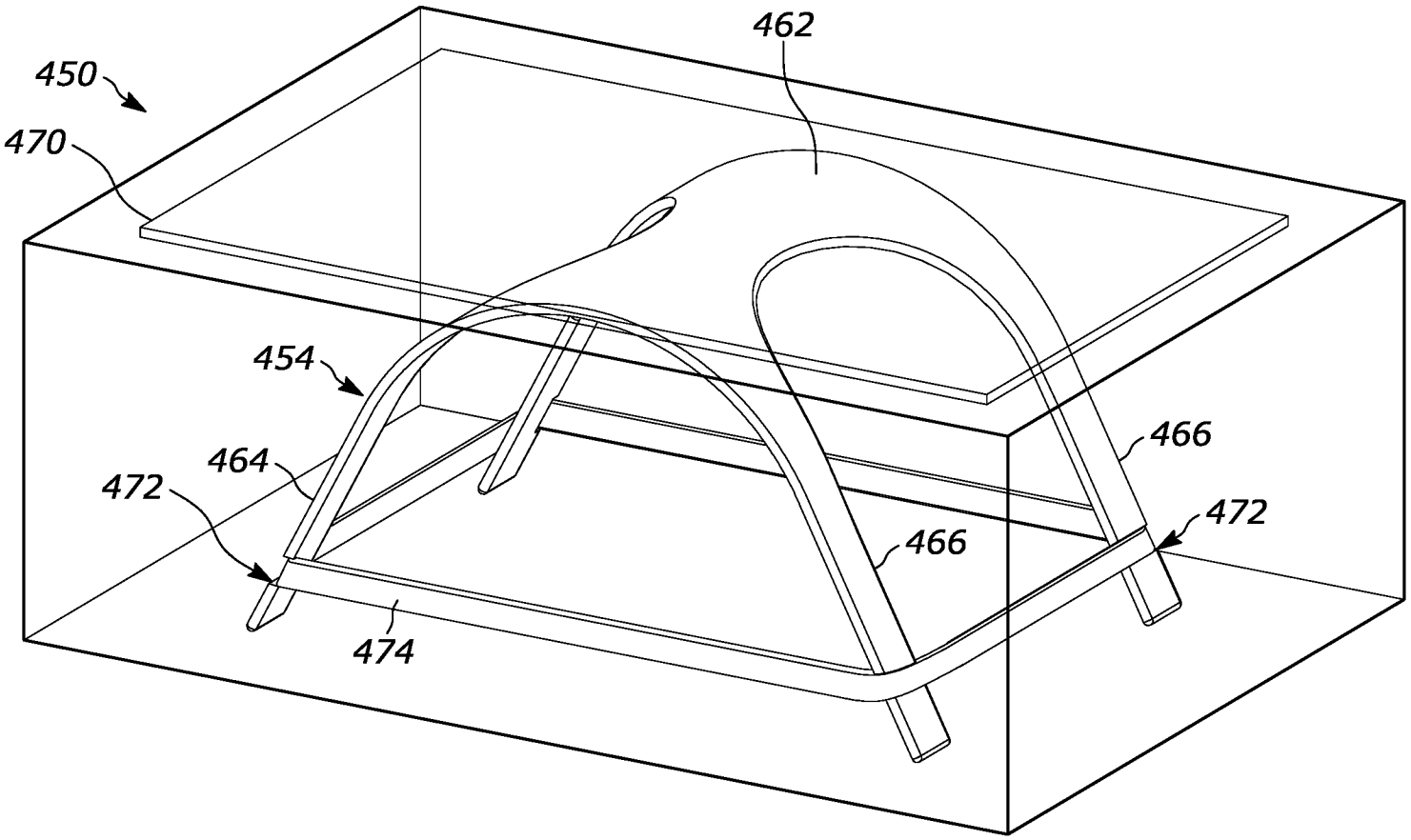
FIG. 13 is a perspective view of an article dispensing assembly including a lifting platform and additional biasing structure where the container and lifting platform are shown as transparent.

An article advancing assembly 450 is shown in FIG. 13. The article advancing assembly includes an article advancer 454 having similar structure and function as article advancer 54. More specifically, article advancer 454 includes an arcuate body 462, at least one first side leg 464, and at least one second side leg 466. At least one of the first and second side legs 464,466 further includes a notch 472 for receiving a biasing structure, such as an elastic band 474. In some forms, notches 472 can be provided in each of the first and second side legs 464,466. The biasing structure can be used to provide additional biasing force to the article advancer 454. It should be appreciated that the biasing structure can be used with other article advancers described herein. The assembly 450 may also include a platform 470, as previously described.

Figure 14:
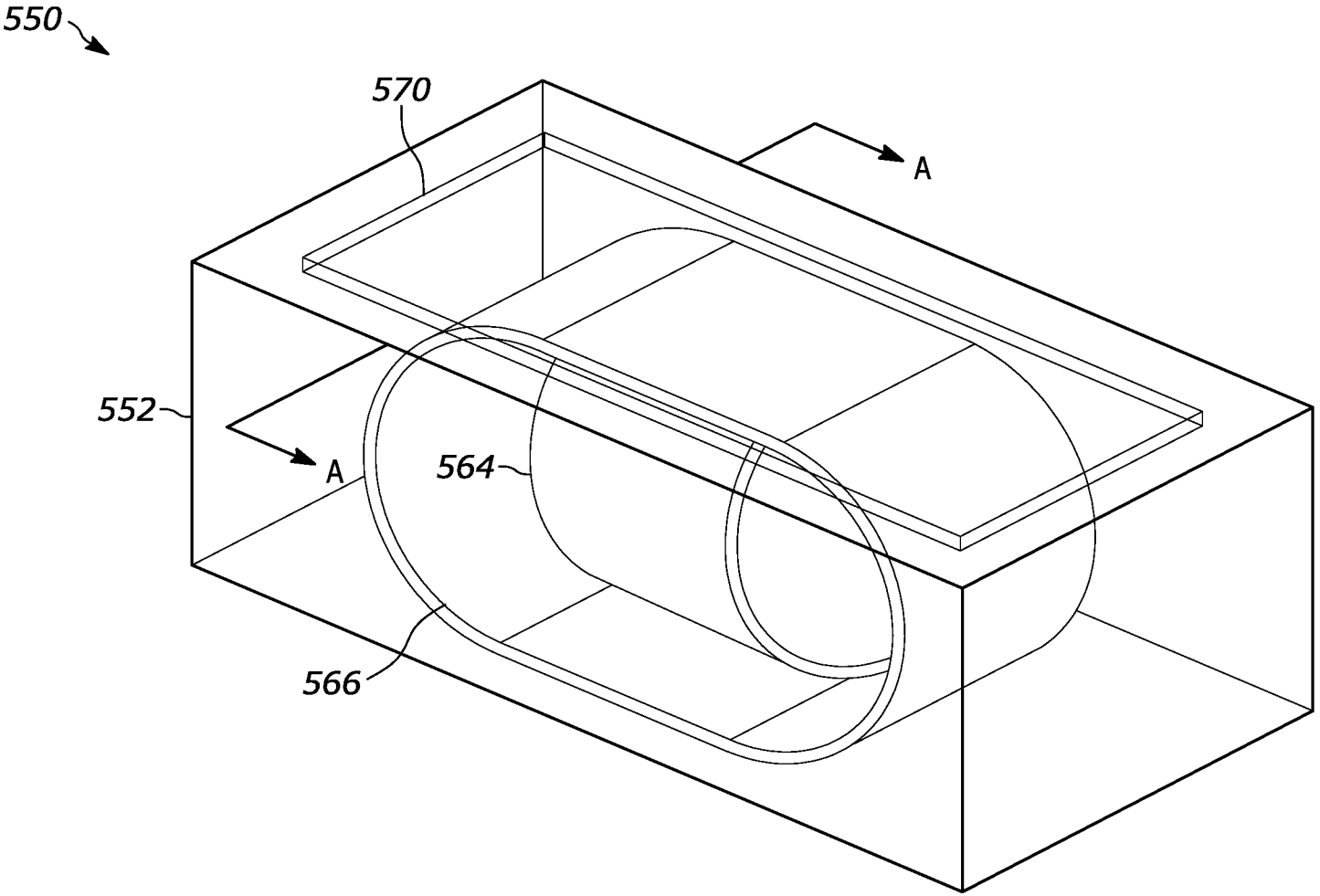
FIG. 14 is a perspective view of another article dispensing assembly including a lifting platform where the container and lifting platform are shown as transparent.
Figure 15:
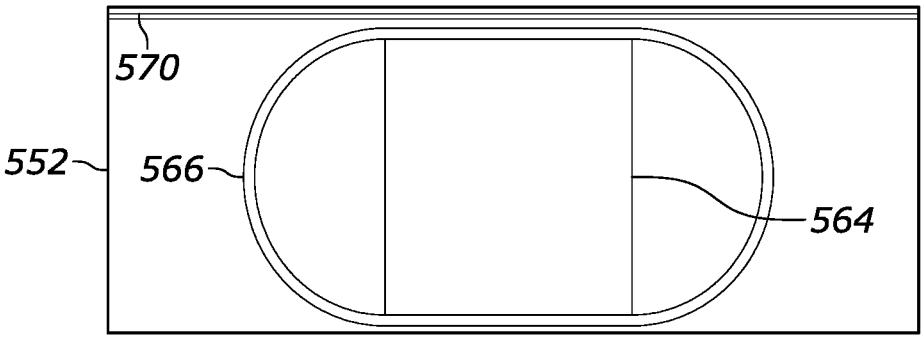
FIG. 15 is a front view of the article dispensing assembly of FIG. 14.
Figure 16:
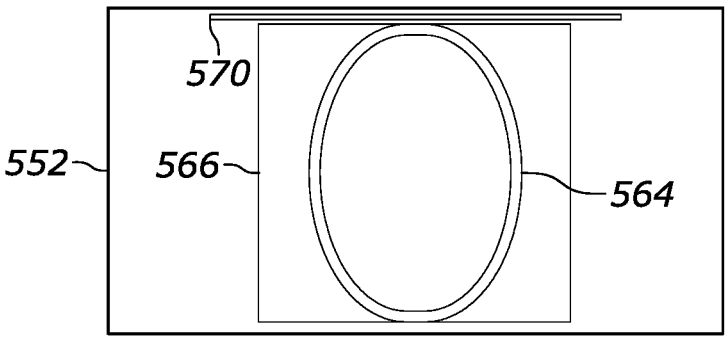
FIG. 16 is a side view of the article dispensing assembly of FIG. 14.
Figure 17:
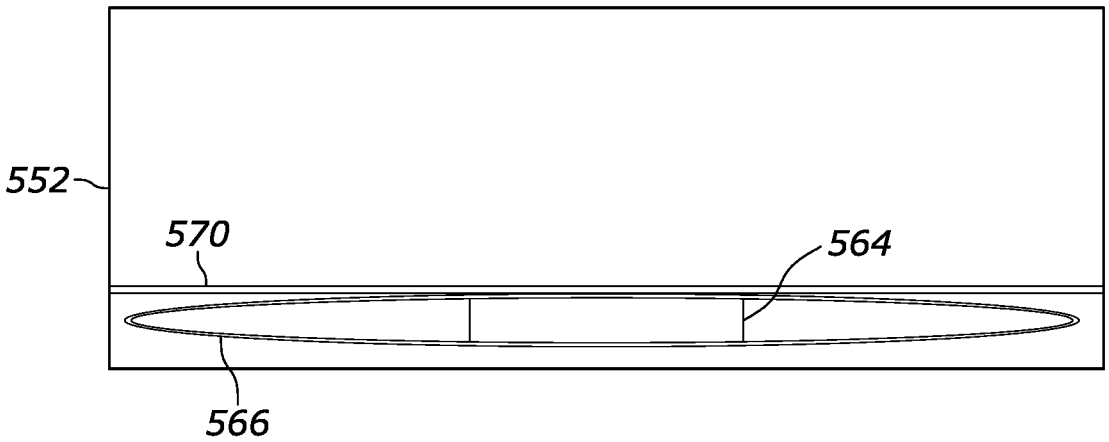
FIG. 17 is a front view of the article dispensing assembly of FIG. 14 in a compressed configuration.
Figure 18:
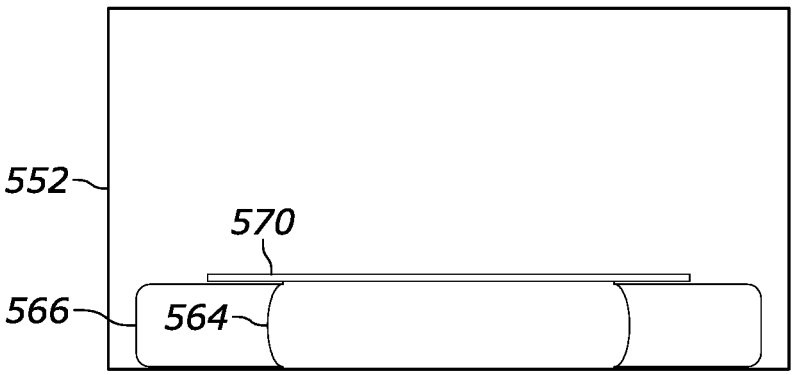
FIG. 18 is a side view of the article dispensing assembly of FIG. 14 in a compressed configuration.

FIGS. 14-18 illustrate a further article advancing assembly 550 including a container 552 and an article advancer 554. The article advancer includes an inner structure 564 and an outer structure 566. Each of the inner and outer structures 564,566 are generally circular, tubular, oval, and the like. As found in FIG. 14 and the side view in FIG. 15, the outer structure 566 is larger than the inner structure 564. A cross sectional view along line A-A in FIG. 14 is shown in FIG. 16. The article advancer 554 is shown in a fully dispensed configuration in FIGS. 14-16 while being shown in a compressed configuration in FIGS. 17 and 18. The assembly 550 may also include a platform 570.

In article advancer 554, at least one of the inner and outer structure 564,566 can provide a biasing force. In one form, both of the inner and outer structures 564,566 provide a biasing force. When moving towards the compressed configuration, each of the inner and outer structure 564,566 flex outwardly and then return to the position shown in FIG. 14 when moving towards the fully dispensed configuration.

Figure 19:
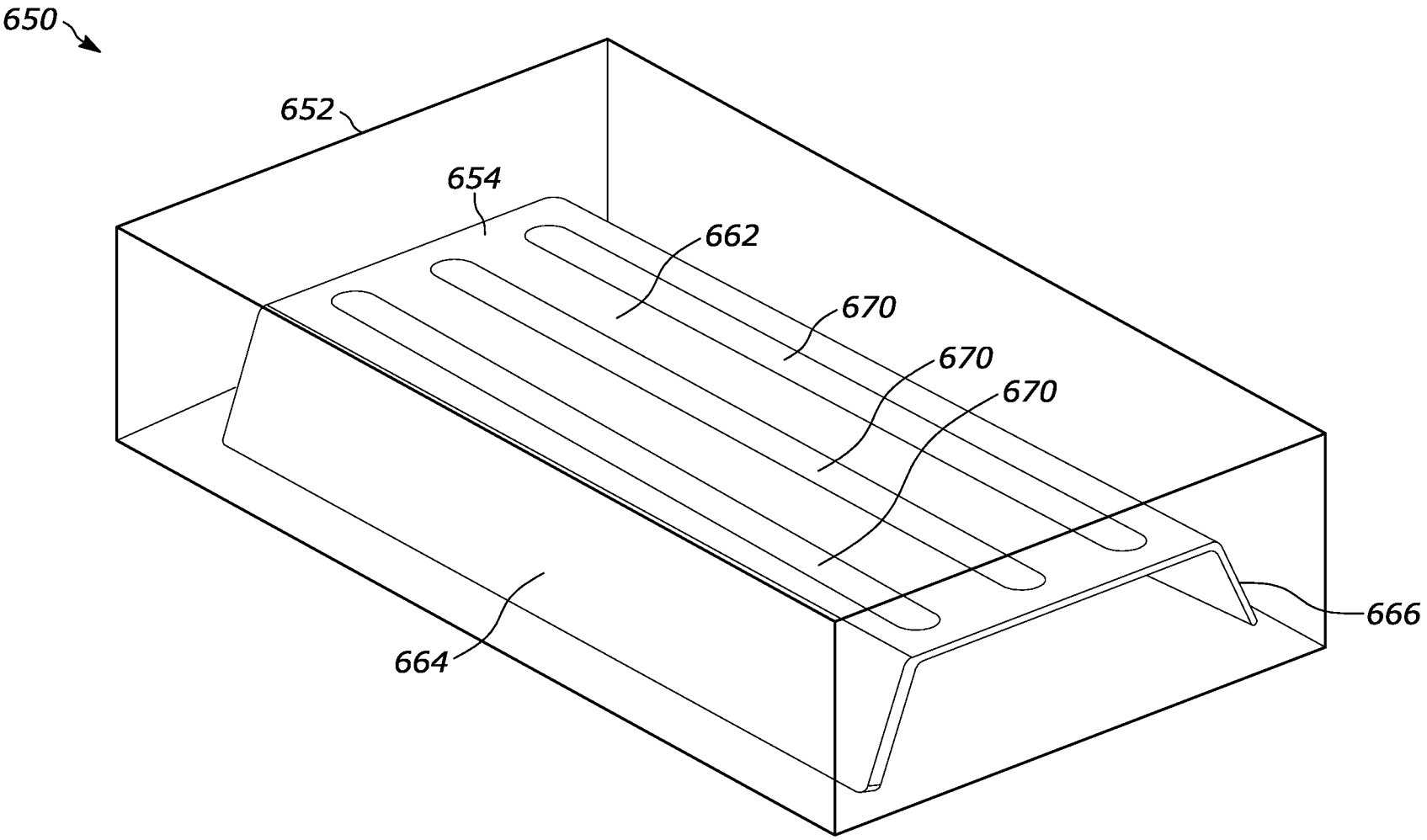
FIG. 19 is a perspective view of another article dispensing assembly where the container is shown as transparent.
Figure 20:
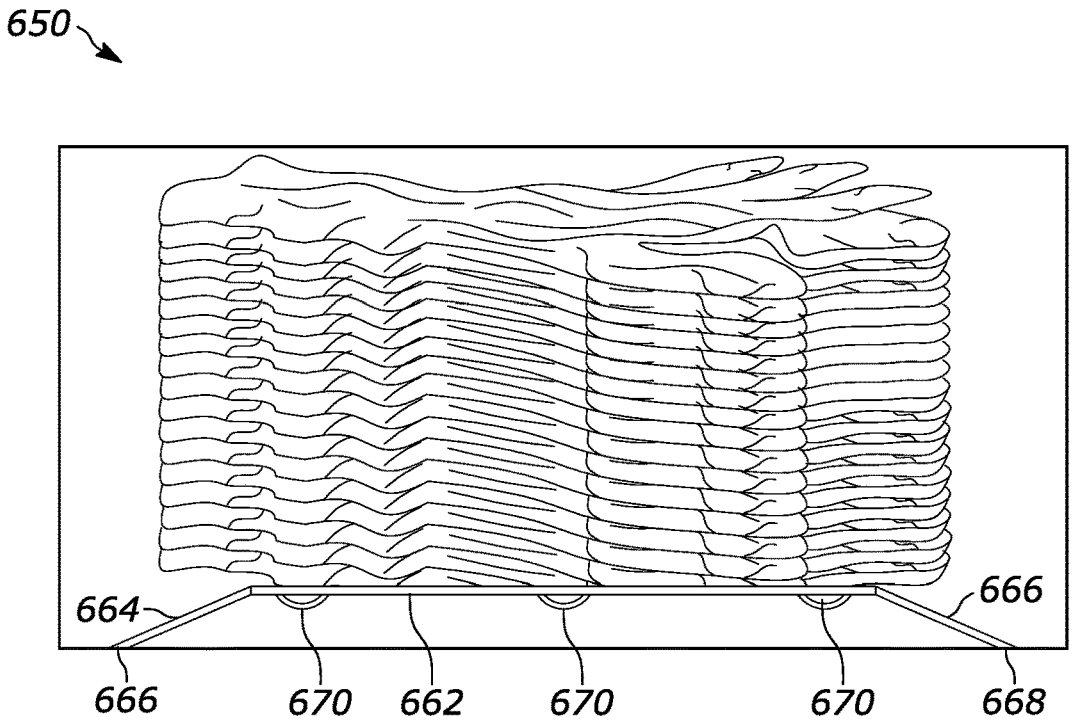
FIG. 20 is a side view of the article dispensing assembly of FIG. 19 in a compressed configuration.
Figure 21:
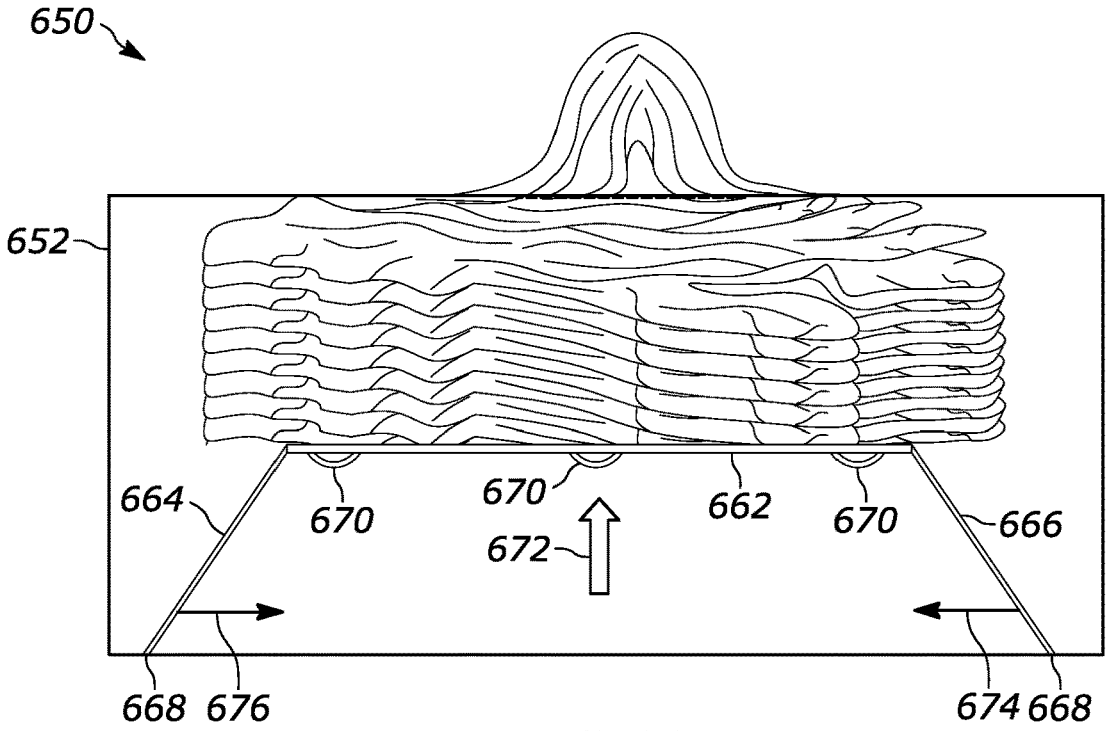
FIG. 21 is a side view of the article dispensing assembly of FIG. 19 in a dispensing configuration.

FIGS. 19-21 illustrate another form of article advancing assembly 650. The assembly 650 includes a container 652 and an article advancer 654. The article advancer 654 includes a base 662, a first side leg 664, and a second side leg 666. While shown as not extending fully to a top portion of the container 652, it should be appreciated that the base 663, first side leg 664, and second side leg 66 may have any dimension such that the article advancer 654 may extend all the way to a top portion of the container 652. The article advancer 654 may also include one or more support structures 670. The support structures 670 may provide rigidity to the base 662.

The article advancer 654 is shown in FIG. 20 in a compressed configuration while being shown as moving towards a fully dispensed configuration in FIG. 21, as represented by arrow 672. Similar to article advancer 54, article advancer 654 provides a biasing force whereby the ends 668 of first and second side legs 664,666 move towards one another when moving from the compressed configuration towards the fully dispensed configuration, as shown by arrows 674,676.

Figure 22:
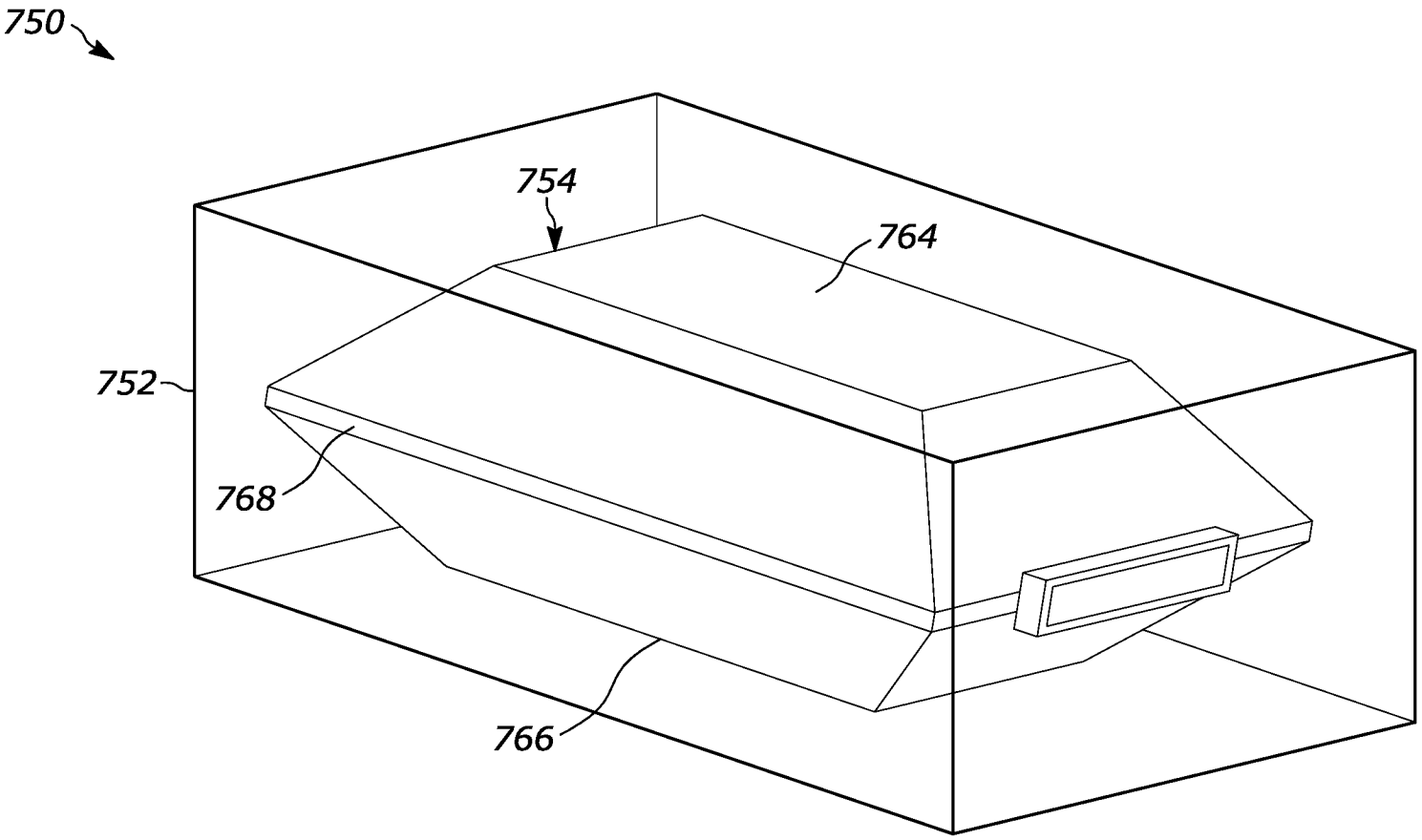
FIG. 22 is a perspective view of another article dispensing assembly where the container is shown as transparent.

A further form of article advancing assembly 750 is shown in FIG. 22. The assembly includes a container 752 and an article advancer 754. The article advancer 754 includes an upper portion 764 and a lower portion 766 joined at an edge 768. The article advancer 754 may also include an internal structure (not shown), such as an internal elastic material, such as a foam material or pad, to provide additional biasing. The article advancer 754 can be moved to the compressed configuration by moving the top portion 764 towards the lower portion 766. By doing so, a biasing force is introduced into the article advancer 754 to bias back towards the fully dispensed configuration. One or more of the upper portion 764 and the lower portion 766 can be made from an elastic material so that the article advancer 754 can flex when moved towards the compressed configuration.

Figure 23:
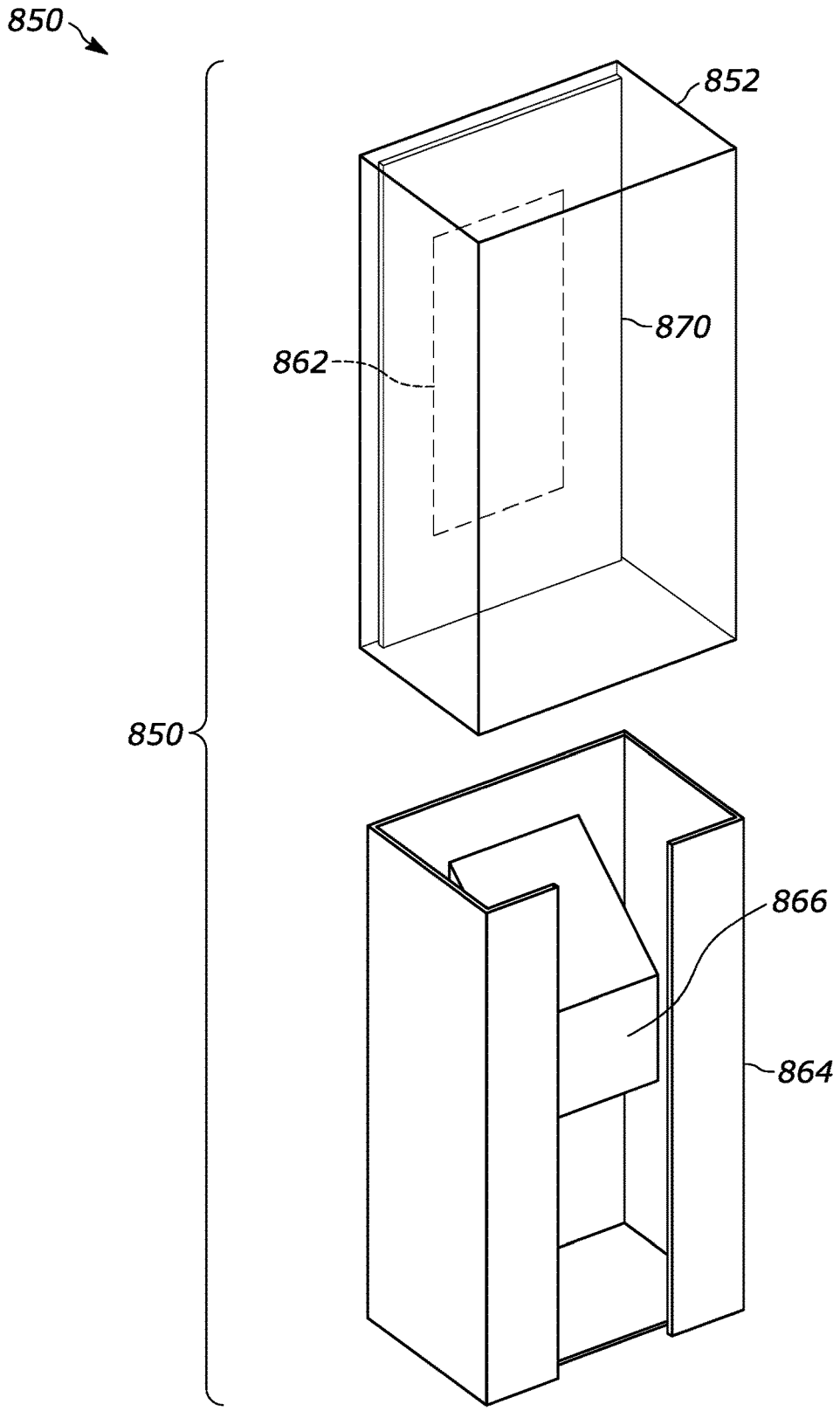
FIG. 23 is an exploded perspective view of another article dispensing assembly including an external article advancer.
Figure 25:
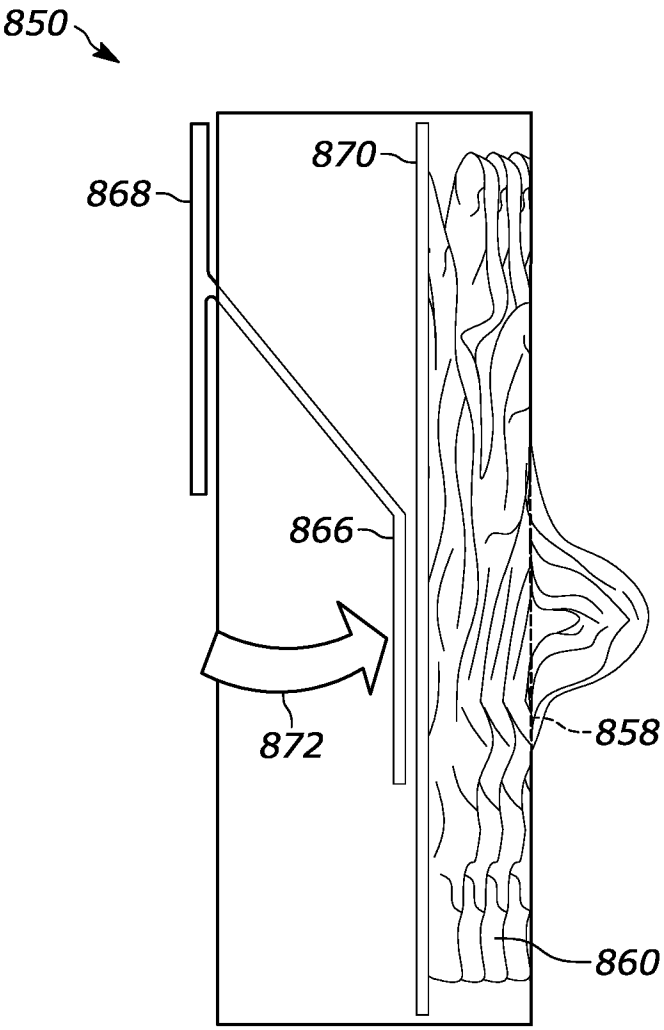
FIG. 25 is a side view of the article dispensing assembly of FIG. 23 in a dispensing configuration.
Figure 24:
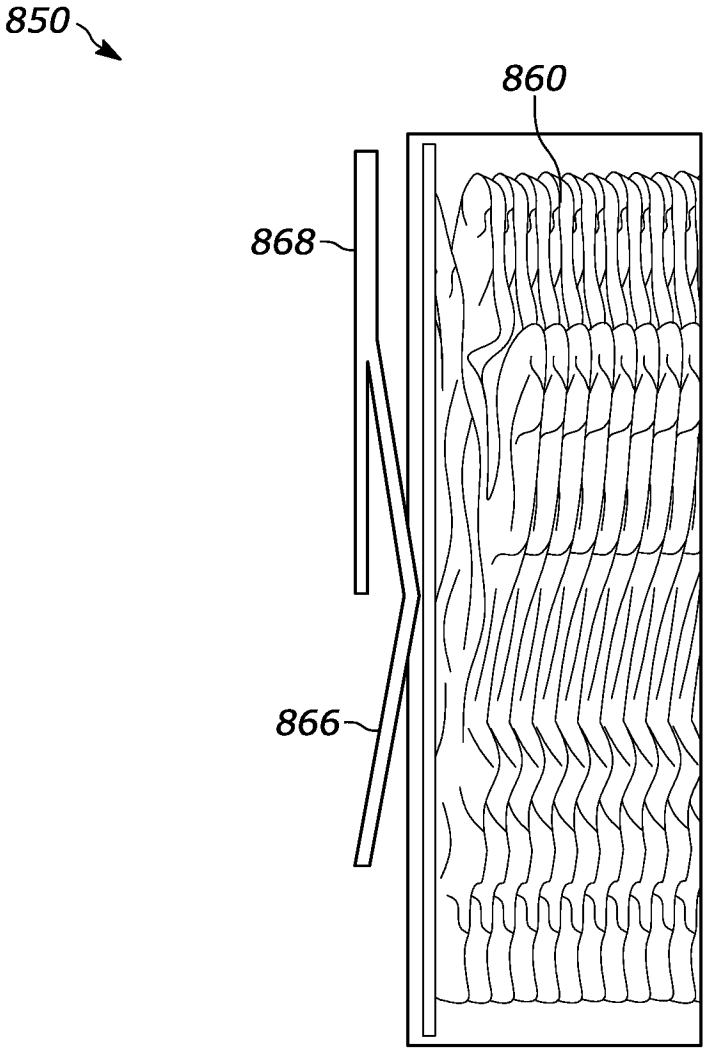
FIG. 24 is a side view of the article dispensing assembly of FIG. 23 in a compressed configuration.

FIGS. 23-25 provide for another form of article advancing assembly 850. Assembly 850 generally includes a container 852 and a holder 864. The holder 864 includes a biasing structure, such as a spring 866. The spring 866 can be used to bias internal contents 860 of the container 852. More specifically, the spring 866 can enter the container 852 via an opening 862. The opening 862 can be formed in a variety of manners. In one form, the opening 862 is designed by a perforated portion of the container 852 that can be pushed inwardly or otherwise removed to permit the spring 866 to enter the container 852. Further, the assembly 850 can include a platform 870 so that spring 866 can provide even biasing force on the contents 860.

FIG. 24 illustrates the assembly 850 in a fully compressed configuration whereby the spring 866 is compressed prior to the contents 860 being dispensed. FIG. 25 illustrates the assembly 850 moving towards the fully dispensed configuration whereby the spring 866 moves in a direction shown by arrow 872. In one form, it can be seen that spring 866 extends through opening 862 which is generally opposite dispensing opening 858. However, other locations of the openings are also contemplated.

Figure 26:
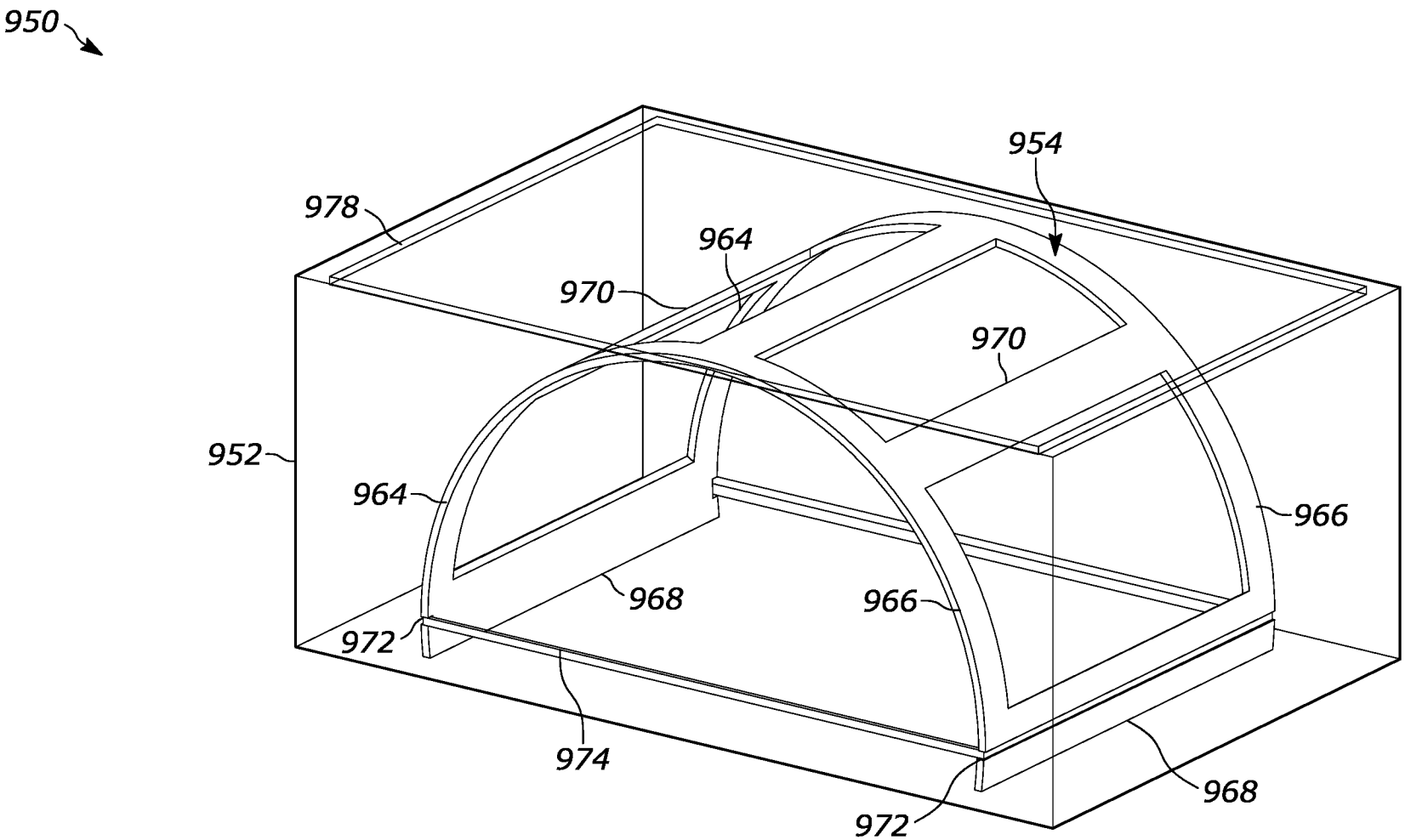
FIG. 26 is a perspective view of another article dispensing assembly including a lifting platform where the container and lifting platform are shown as transparent.

FIG. 26 illustrates an embodiment which is similar to that shown in FIG. 10. In FIG. 26, an article advancing assembly 950 is provided having a container 952 and an article advancer 954. The article advancer 954 is shown having an arcuate body 962, at least one first side leg 964, and at least one second side leg 966. The article advancer 954 also includes a plurality of support ribs 970. The support ribs extend between opposite sides of the article advancer 954. In one form, some of the support ribs 970 form ends 968. It should be appreciated that the ribs 970 may provide further stability to the article advancer 954 and/or between the respective legs 964,966. The article advancer 954 functions in a similar manner as article advancer 54 whereby article advancer 954 provides a biasing force when in a compressed configuration and moves towards a fully dispensed configuration. Further, the ends 970 move towards one another when moving from the compressed configuration to the fully dispensed configuration.

The article advancer 954 may also include a notch 972 for receiving a biasing structure, such as an elastic band 974. In some forms, notches 972 can be provided in each of the first and second side legs 964,966. The biasing structure can be used to provide additional biasing force to the article advancer 954. It should be appreciated that the biasing structure can be used with other article advancers described herein. The assembly 950 may also include a platform 978, as previously described.

Figure 27:
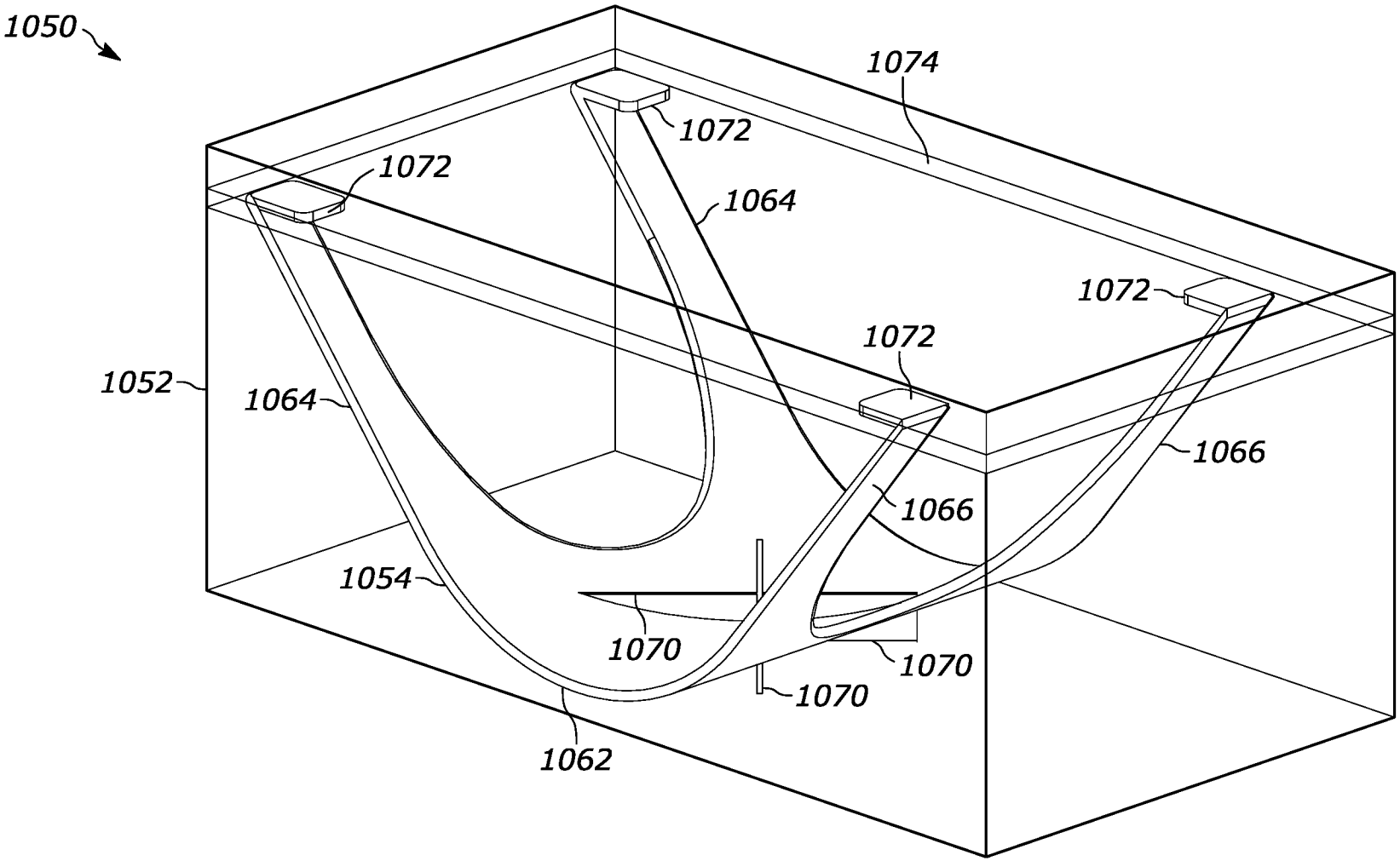
FIG. 27 is a perspective view of another article dispensing assembly including a lifting platform where the container and lifting platform are shown as transparent.
Figure 28:
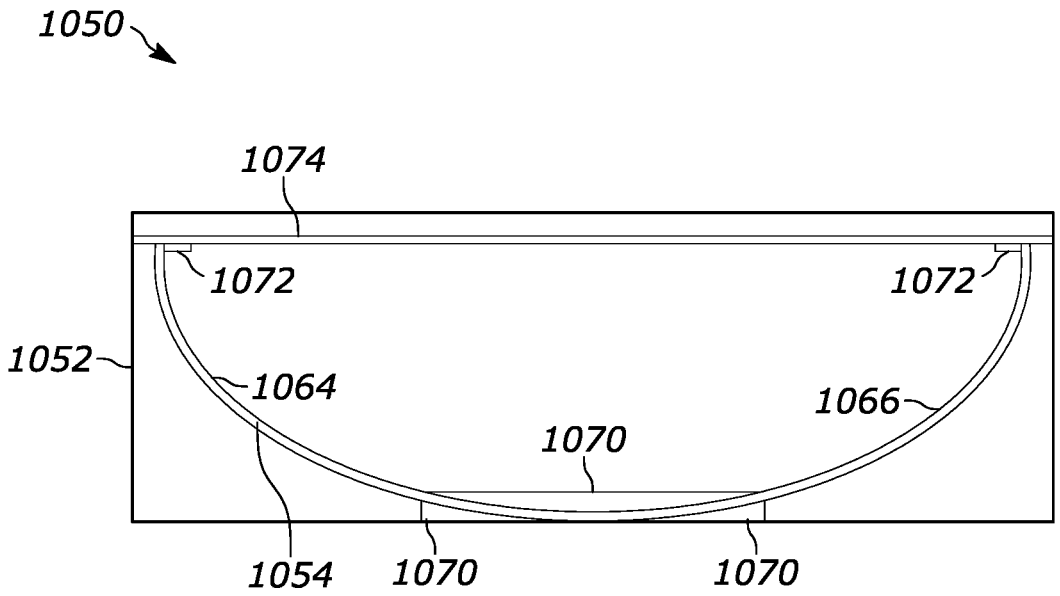
FIG. 28 is a front view of the article dispensing assembly of FIG. 27 in an uncompressed configuration.
Figure 29:
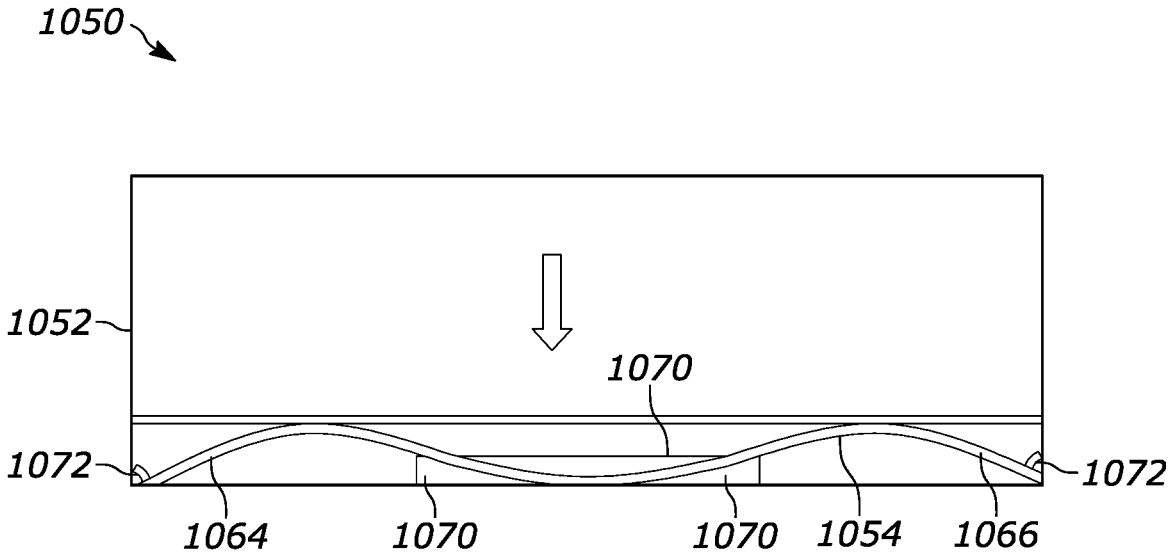
FIG. 29 is a front view of the article dispensing assembly of FIG. 27 in a compressed configuration.

Yet another embodiment of an article advancing assembly is provided in FIGS. 27-29. Article advancing assembly 1050 includes a container 1052 and an article advancer 1054. The article advancer 1054 generally includes a body 1062, at least one first side leg 1064, and at least one second side leg 1066 opposite the first side. In one form, the body 1062 is generally arcuate which can be a constant radius, an increasing radius, a decreasing radius, a variable radius, and the like. The article advancer 1054 may also include support structure, such as ribs 1070. The ribs 1070 may provide rigidity and/or otherwise provide a stable base to maintain the orientation of the article advancer 1054. The article advancer 1054 may also include feet 1072 which can be used to engage platform 1074.

As shown in FIG. 27, the article advancer 1054 is generally oriented upside-down compared to article advancer 54 in FIGS. 1 and 2. In this form, the article advancer 1054 is shown in FIG. 28 in the fully dispensed configuration whereby the platform 1074 is pushed by feet 1072 towards a dispensing opening (not shown).

FIG. 29 illustrates the article advancer 1054 in the fully compressed configuration. Compared to FIG. 1, the article advancer 1054 is not flat, but instead results in the legs 1064,1066 being in an arcuate configuration. This is a result of the ribs 1070 generally maintaining the shape and configuration of the base 1062.

Figure 30:
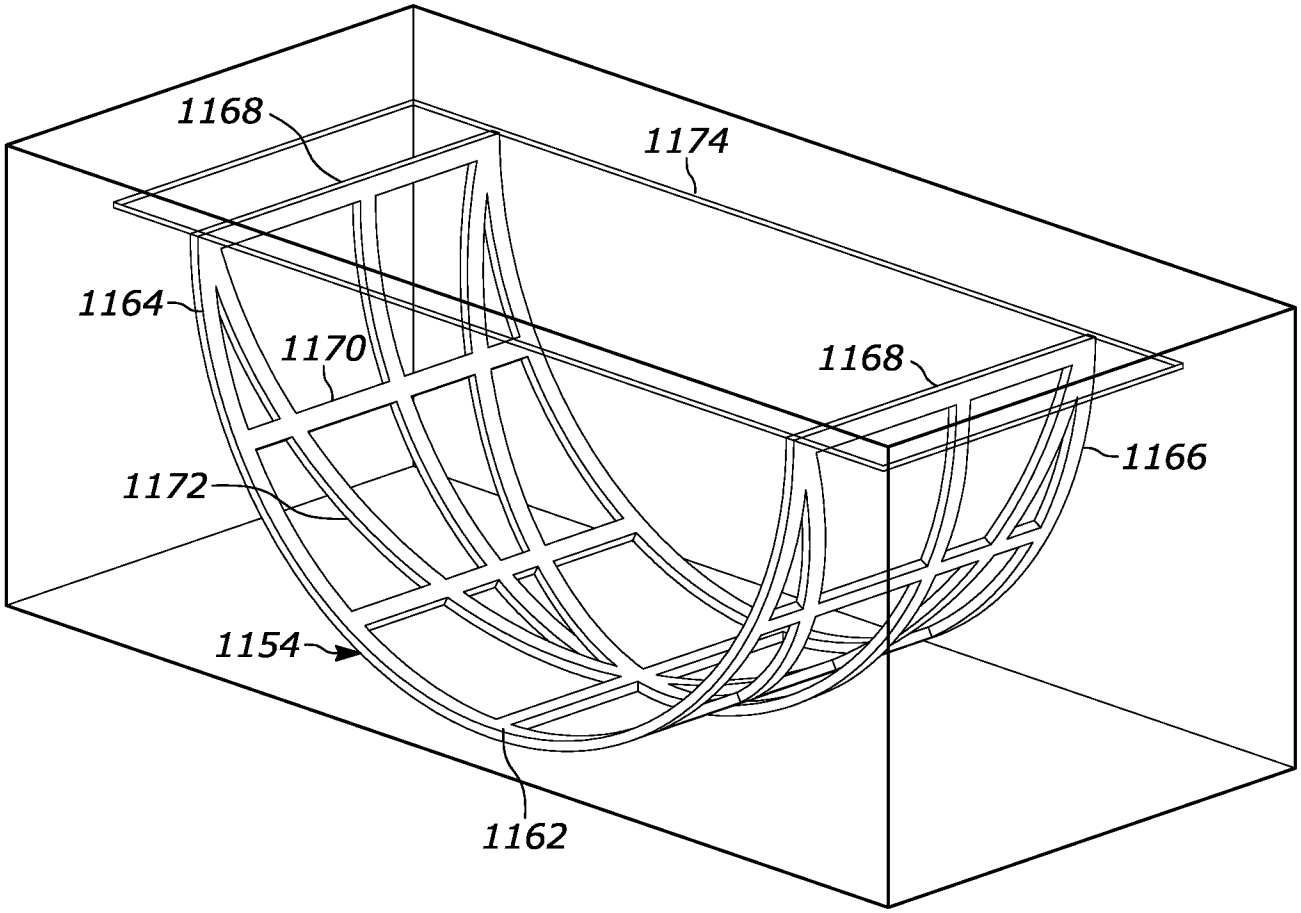
FIG. 30 is a perspective view of another article dispensing assembly including a lifting platform where the container and lifting platform are shown as transparent.

FIG. 30 illustrates another inverted article advancer when compared to the embodiment shown in FIGS. 1 and 2. More specifically, article advancer 1154 is shown having a body 1162, at least one first side leg 1164, and at least one second side leg 1166 opposite the first side. In one form, the body 1162 is generally arcuate which can be a constant radius, an increasing radius, a decreasing radius, a variable radius, and the like.

The article advancer 1154 may also include a plurality of ribs 1170 and additional support structures 1172. Article advancer 1154 will move in a similar manner as the article advancer 54 between the compressed configuration and the fully dispensed configuration. However, as seen from FIG. 30, the article advancer is inverted and also includes a platform 1174 configured to contact ends 1168.

Figure 31:
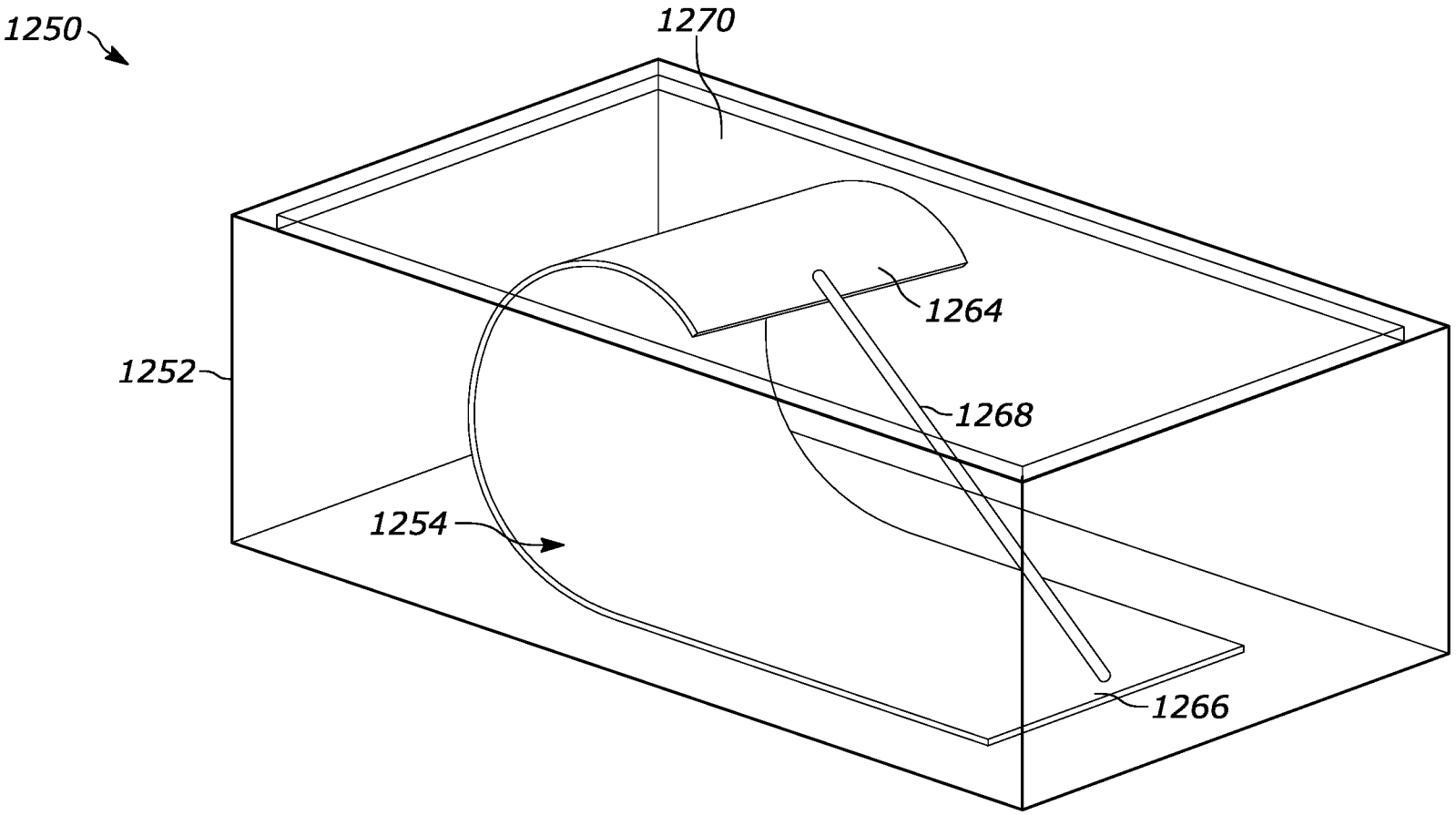
FIG. 31 is a perspective view of another article dispensing assembly including a lifting platform where the container and lifting platform are shown as transparent.

FIG. 31 illustrates a further form of article advancing assembly 1250 including a container 1252, an article advancer 1254, and a platform 1270. The article advancer incudes a body 1262, a first end portion 1264, and a second end portion 1266. Further, a resistance device, such as an elastic band 1268, is configured to extend between the first and second end portions 1264,1266. When in a compressed configuration, the first and second end portions 1264,1266 may be adjacent to one another, such as if the article advancer 1254 is somewhat rolled or folded upon itself. The article advancer 1254 is naturally biased to extend towards the fully dispensed configuration, such as shown by FIG. 31. Therefore, when folded or rolled upon itself, the article advancer 1254 imparts a biasing force causing the first and second end portions 1264,1266 to extend away from one another. The elastic band 1268 is provided to slightly resist the biasing force of the article advancer 1254 and otherwise resist the article advancer from extending completely flat.

Figure 32:
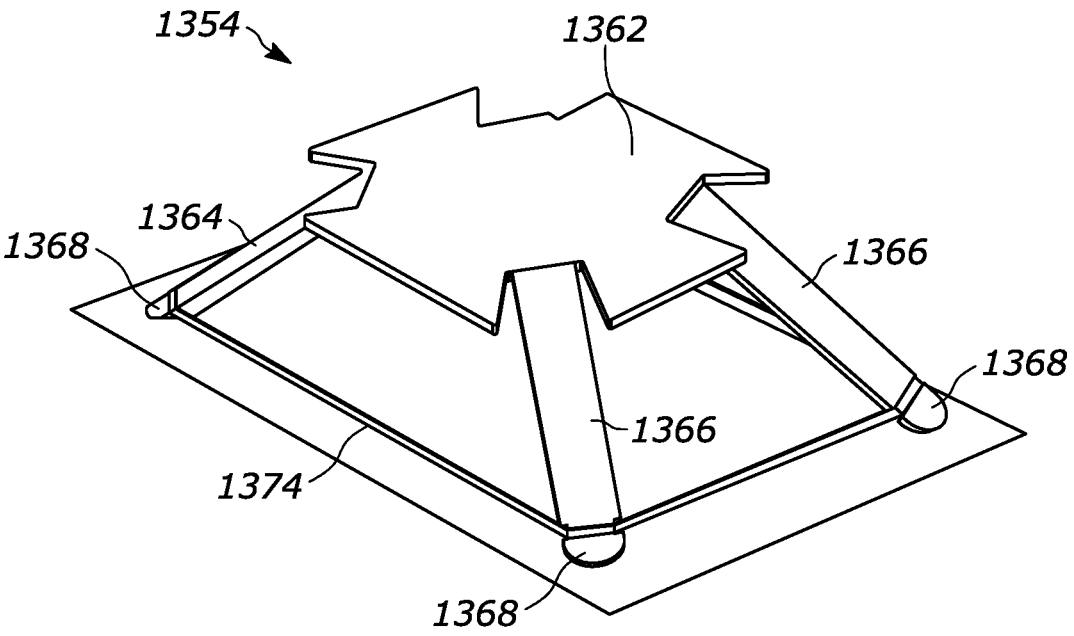
FIG. 32 is a perspective view of another article advancer.
Figure 33:
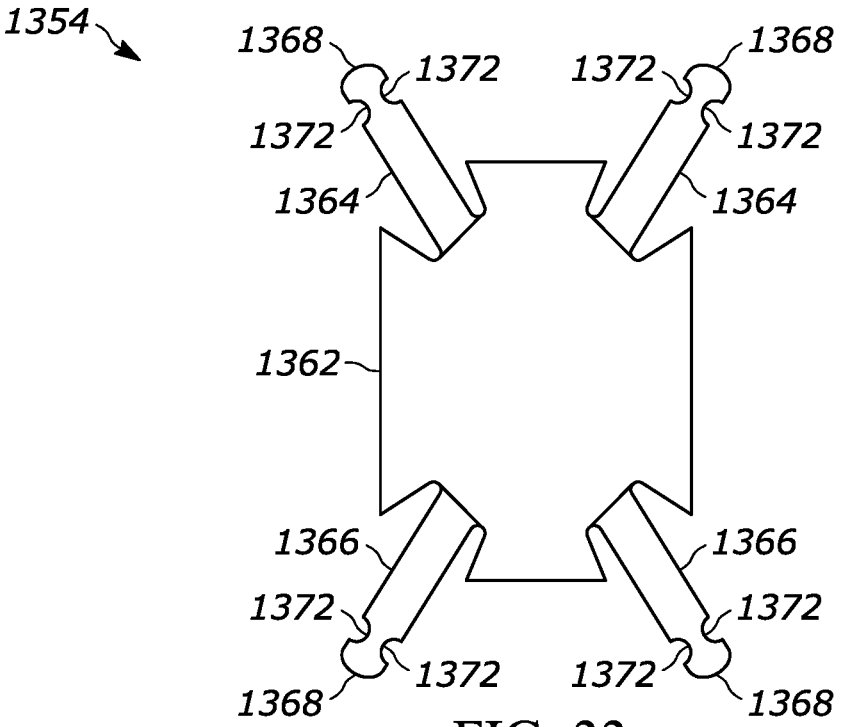
FIG. 33 is a top view of the article advancer of FIG. 32.

A further article advancer 1354 is shown in FIGS. 32 and 33. The article advancer 1354 includes a body 1362 with first side legs 1364 and second side legs 1366. Each of the side legs 1364,1366 includes notches 1372 configured to receive and retain a portion of an elastic member 1374. In the compressed configuration, ends 1368 extend outwardly away from one another such that the article advancer 1354 is generally flat. The elastic member 1374 biases the article advancer towards the fully dispensed configuration, such as shown in FIG. 32. In one form, the body 1362 functions as a base to lift the contents towards the dispensing opening.

Figure 34:
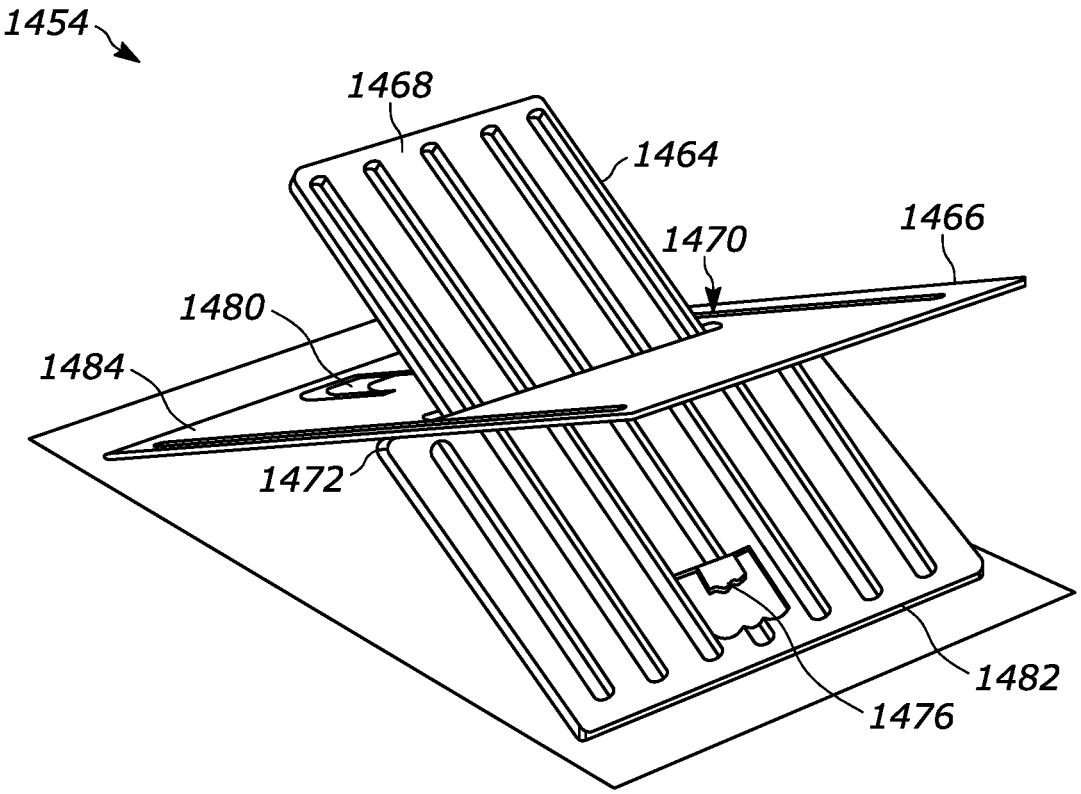
FIG. 34 is a perspective view of another article advancer.
Figure 35:
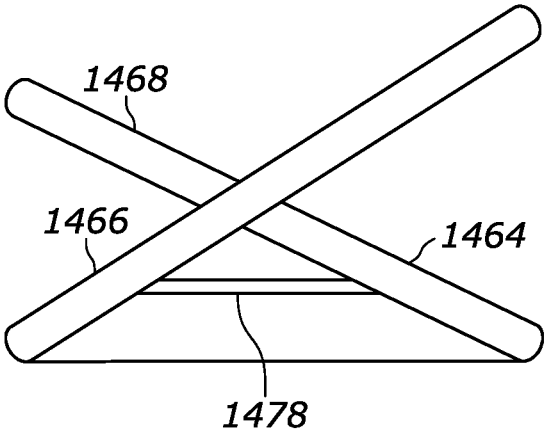
FIG. 35 is a front view of the article advancer of FIG. 34 in a container.

Article advancer 1454 is shown in FIGS. 34 and 35 having a first generally planar member 1464 and a second generally planar member 1466. The first planar member includes a narrowed portion 1468 which extends through an opening 1470 whereby a shoulder portion 1472 of the first planar member 1464 contacts the second planar member 1466. The first planar member 1464 includes a tab 1476 to engage a first portion of an elastic member 1478 while the second planar member 1466 includes a tab 1480 to engage a second portion of the elastic member 1478. In other words, the elastic member 1478 extends between the tabs 1476, 1480 to bias these portions towards one another. When in the compressed configuration, ends 1482,1484 extend away from one another. The elastic member 1478 biases the ends 1482,1484 towards one another to cause the article advancer to move towards the fully dispensed configuration.

Figure 36:
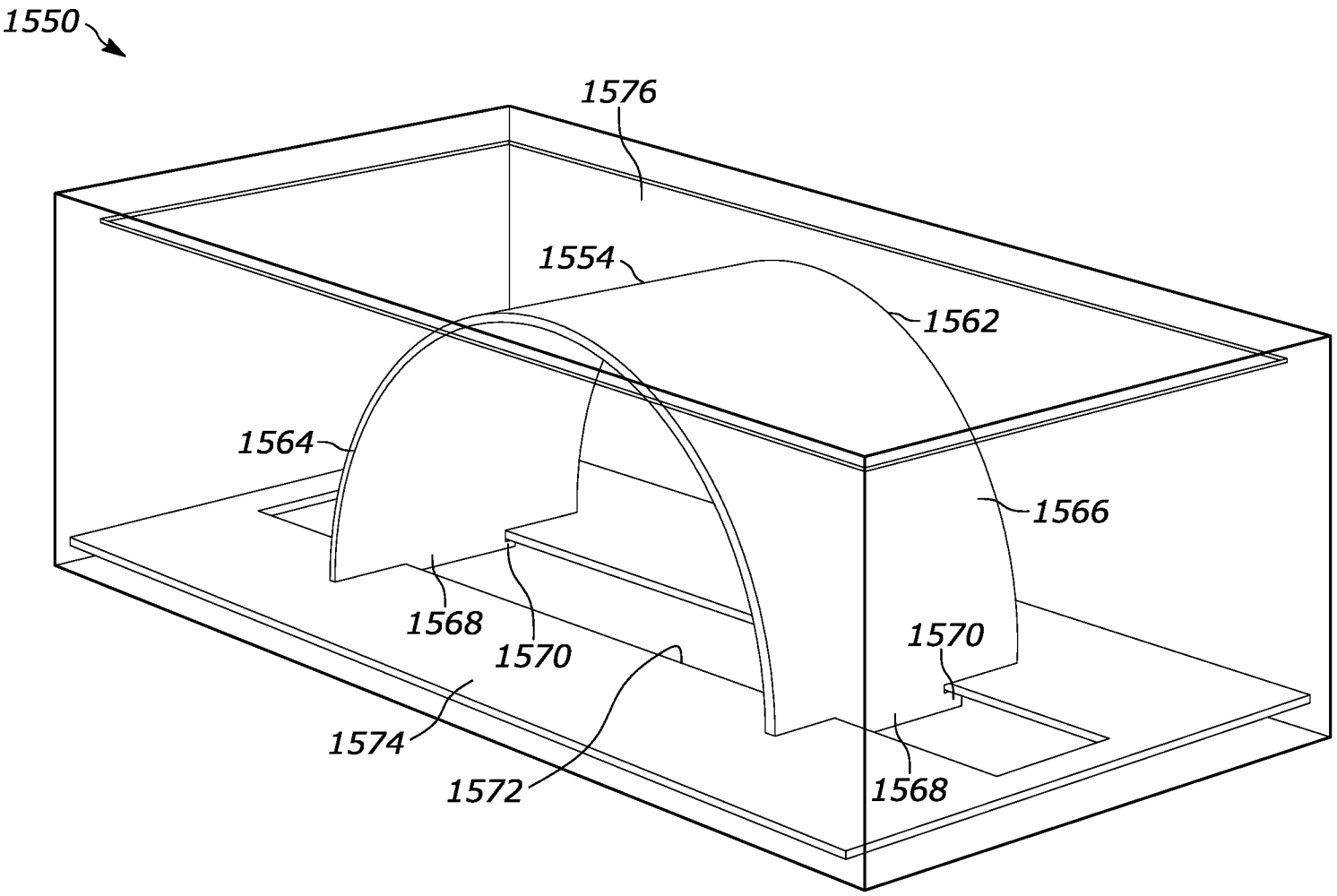
FIG. 36 is a perspective view of another article dispensing assembly including a lifting platform where the container and lifting platform are shown as transparent.

Article advancing assembly 1550 is shown in FIG. 36. In this form, an article advancer 1554 is shown having a body 1562, a first side leg 1564, and a second side leg 1566. Each of the first and second side legs 1564,1566 include ends 1568 having tabs 1570. Tabs 1570 engage a slot 1572 in a base member 1574. In operation, the ends 1568 slide within the slot 1572 to extend towards one another in the fully dispensed configuration and away from one another in the compressed configuration. The article advancer 1554 may also be used with a platform 1576.

Figure 37:
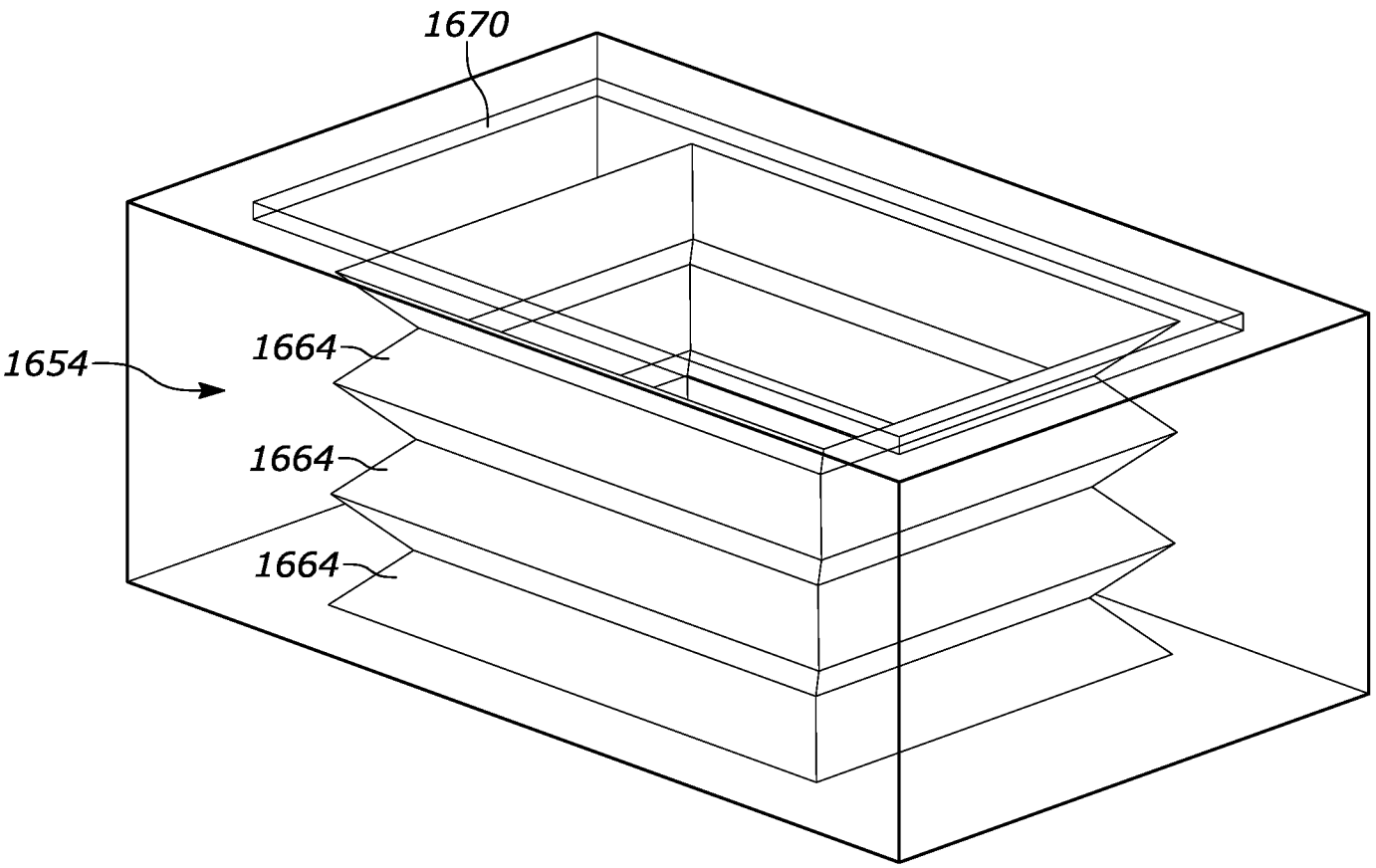
FIG. 37 is a perspective view of another article dispensing assembly including a lifting platform where the container and lifting platform are shown as transparent.

Article advancer 1654 is shown in FIG. 37 and generally takes an accordion-like form. The article advancer 1654 includes a plurality of bevels 1664 that are joined together. The article advancer 1654 can include any number of bevels 1664 as desired. In the compressed configuration, the bevels 1664 are compressed towards one another. Due to the nature of the materials of the bevels 1664 and how they are joined, the article advancer 1654 will have a biasing force when compressed. For example, the article advancer 1654 may be an integral structure, such as a molded plastic material, that elastically deforms to the compressed configuration and will provide a biasing force towards the fully dispensed configuration, such as shown in FIG. 37. The article advancer 1654 may also include a platform 1670.

Figure 38:
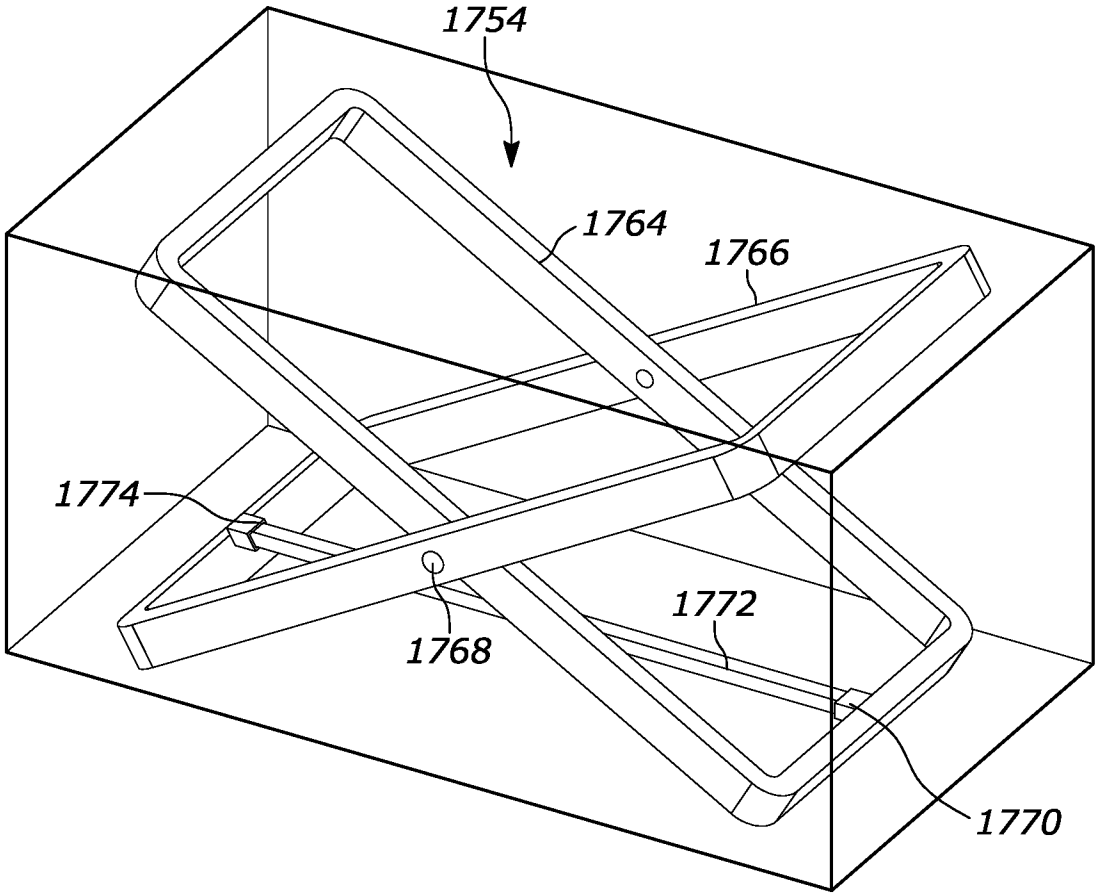
FIG. 38 is a perspective view of another article dispensing assembly where the container is shown as transparent.

FIG. 38 illustrates article advancer 1754 which includes an inner hoop structure 1764 and an outer hoop structure 1766. The inner hoop structure is positioned within the outer hoop structure and is attached thereto at a pivot point 1768. The inner hoop structure 1764 includes a first connector 1770 for coupling to a first end of an elastic band 1772 while the outer hoop structure 1766 includes a second connector 1774 for coupling to a second end of the elastic band 1772.

In the compressed configuration, the inner hoop structure 1764 is substantially within the outer hoop structure 1766 such that the article advancer 1754 is generally flat. The elastic band 1772 biases tab 1770 towards tab 1774, such as shown in FIG. 38 which thereby can elevate the contents of the container for dispensing.

Figure 39:
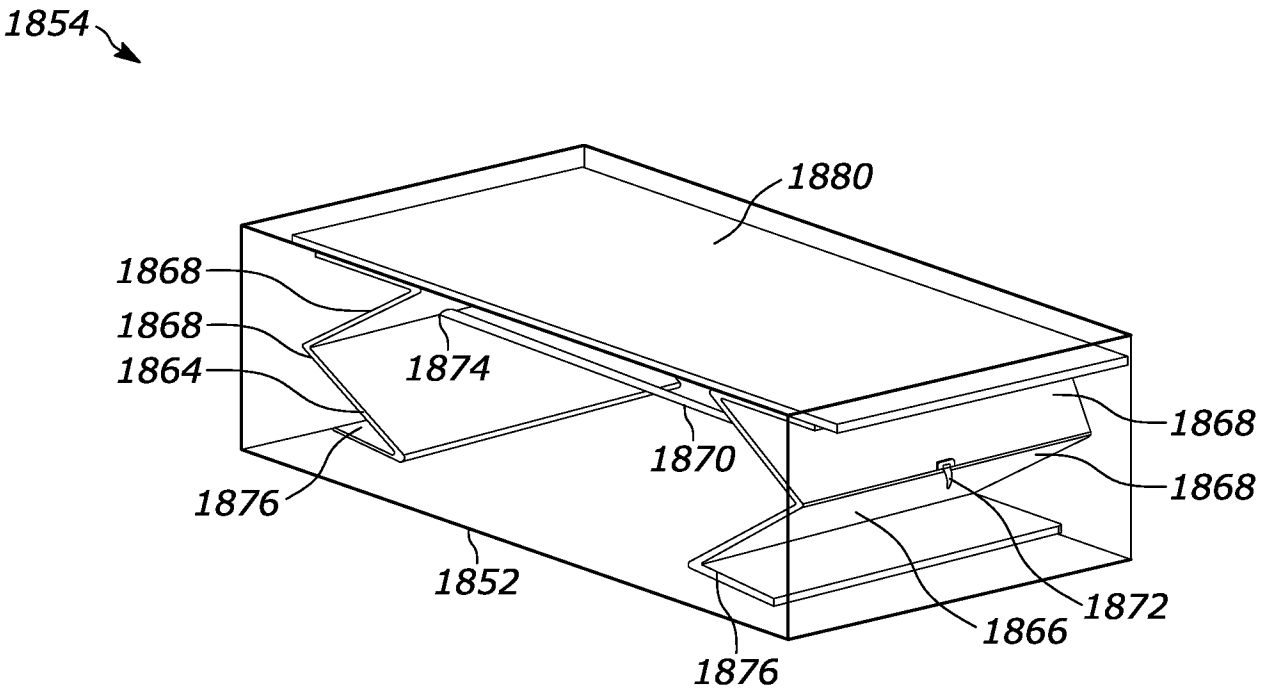
FIG. 39 is a perspective view of another article dispensing assembly including a lifting platform where the container is shown as transparent.

FIG. 39 illustrates a further assembly 1850 including an article advancer 1854 which includes a first folded portion 1864 and a second folded portion 1866. The folded portions 1864,1866 are generally separated from one another, but each includes multiple folded sections 1868. The folded portions 1864,1866 may provide at least some biasing force from a compressed configuration when generally flattened, towards the fully dispensed configuration, as shown in FIG. 39. However, the article advancer 1654 may also include a further biasing structure, such an elastic band 1870 which extends between a first connection 1872 and a second connection 1874. The elastic band 1870 biases the first and second connections 1872,1874 towards one another. However, in one form, bases 1876 of each of the first and second folded portions 1864,1866 may be secured to container 1852 such that the bases 1876 do not move. The resulting biasing force from the elastic member can help move the first and second folded portions to the fully dispensed configuration, elevating platform 1880. In some forms, the first and second folded portions 1864,1866 do not provide any biasing force such that all biasing force comes from the elastic member 1870.

Figure 40:
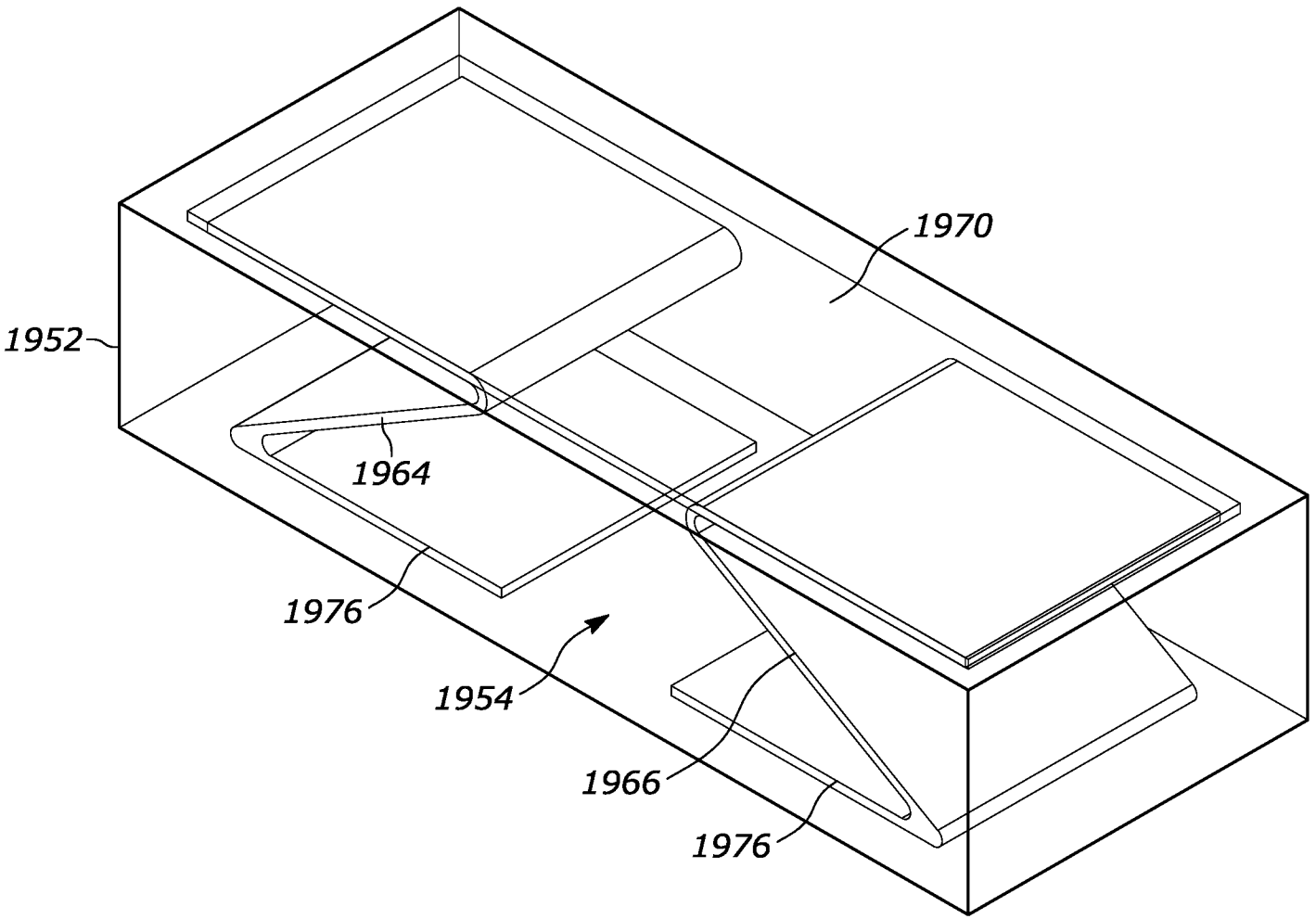
FIG. 40 is a perspective view of another article dispensing assembly including a lifting platform where the container and lifting platform are shown as transparent.

Article advancer 1954 in FIG. 40 is somewhat similar to article advancer 1854. Article advancer 1954 includes a first folded spring 1964 and a second folded spring 1966. The first and second springs 1964,1966 can be secured to the container 1952 at bases 1976, but may not necessarily be secured thereto. The first and second folded springs 1964, 1966 can be compressed to be relatively flat in the compressed configuration and then bias towards the fully dispensed configuration, as shown in FIG. 40. The first and second folded springs may cooperate with a platform 1970 to dispense contents of the container 1952.

Figure 41:
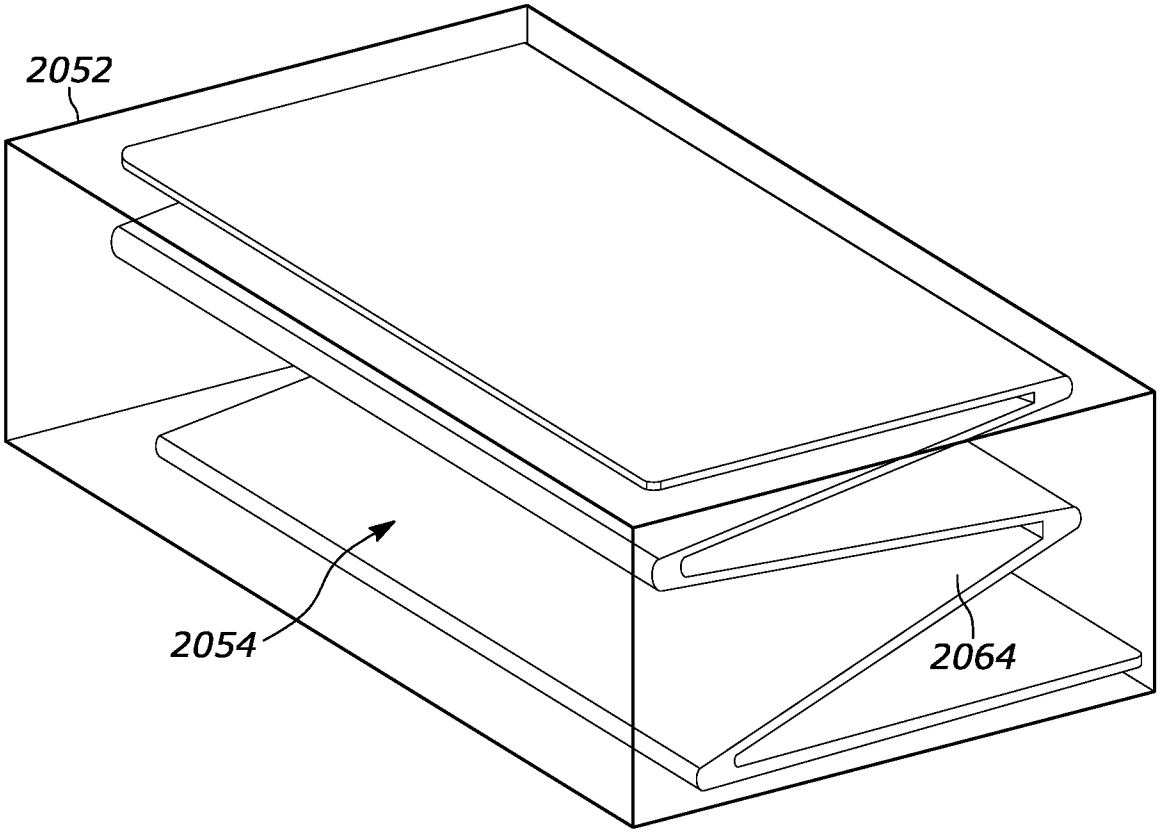
FIG. 41 is a perspective view of another article dispensing assembly where the container is shown as transparent.

FIG. 41 illustrates an article advancer similar to article advancer 1954 in FIG. 40. More specifically, article advancer 2054 includes a folded spring 2064 that generally extends along the length of container 2052. As folded spring 2064 covers a majority of the length of the container 2052, only a single folded spring is needed to maintain balanced dispensing of the contents of the container 2052. Further, the folded spring 2064 can include a generally flat upper surface 2070 such that a platform may not be needed. The article advancer 2054 proceeds from the compressed configuration towards the fully dispensed configuration (shown in FIG. 41) in generally the same manner described for article advancer 1954.

Figure 42:
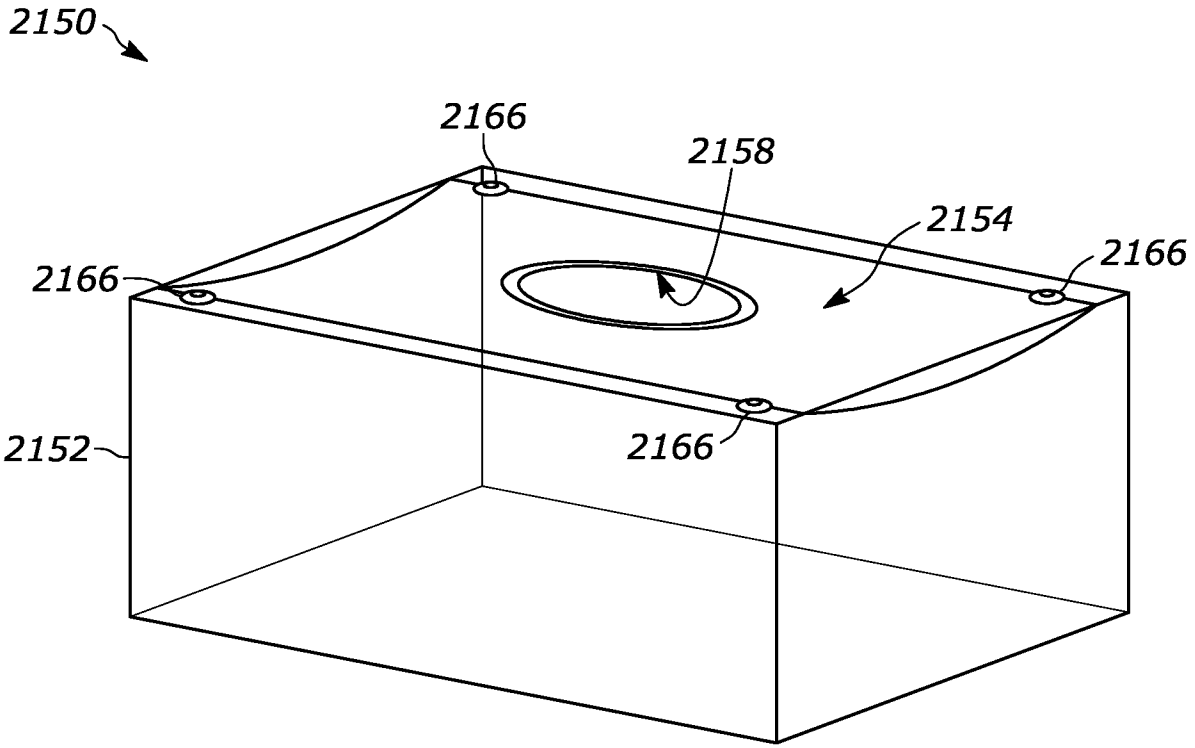
FIG. 42 is a perspective view of another article dispensing assembly where the container is shown as transparent.
Figure 43:
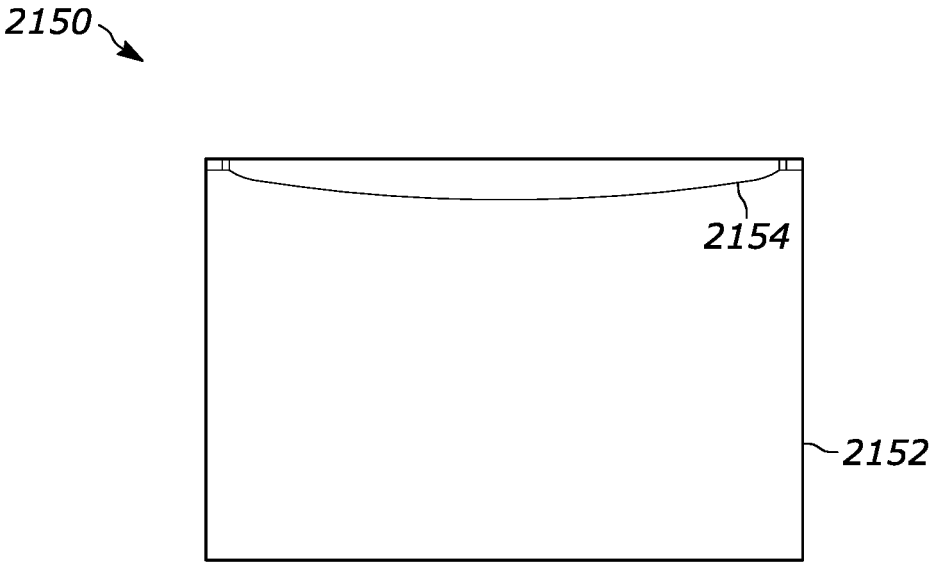
FIG. 43 is a side view of the article dispenser of FIG. 42 in a fully dispensed configuration.
Figure 44:
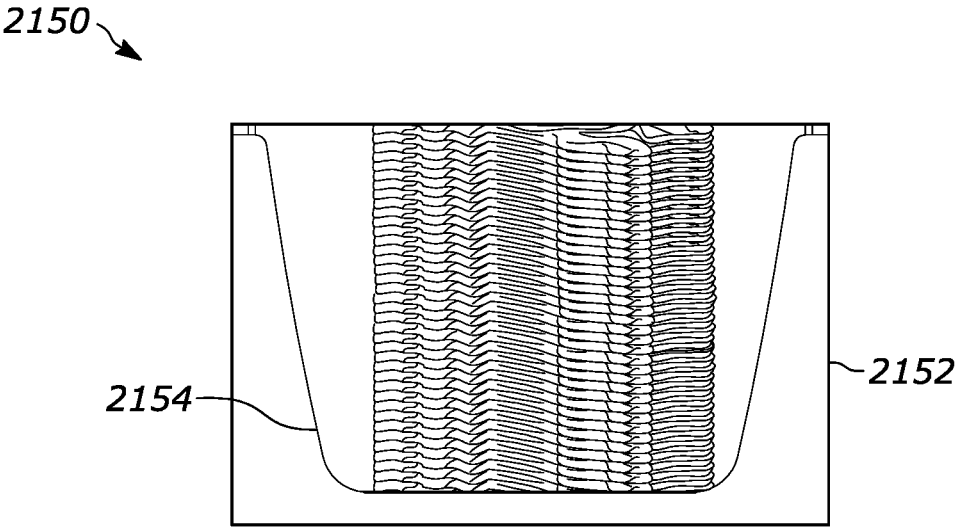
FIG. 44 is a side view of the article dispenser of FIG. 42 in a compressed configuration.

A further article advancing assembly 2150 is shown in FIGS. 42-44. The assembly 2150 includes a container 2152 and an article advancer 2154 for biasing contents towards a dispensing opening 2158. The article advancer 2154 includes an elastic sheet 2164 that is coupled to the container 2152. The elastic sheet 2164 may be coupled to the container 2152 through an adhesive, fasteners 2166, and the like. In one form, multiple fasteners 266 may be used, such as at the corners, but additional fasteners may be included. The article advancer 2154 is generally shown in the fully dispensed configuration in FIGS. 42 and 43 whereas it is shown in a compressed configuration in FIG. 44.

The components described herein may be made from a variety of different materials and are not limited. In one form, the containers may be made from cardboard, plastic, paper, and other conventional materials. As noted above, the containers may also take a variety of different forms, such as boxes, bags, combinations of boxes and bags, and the like.

The article advancers may similarly be made from a variety of different materials. In the forms where the article advancers are desired to be flexible, such as with article advancer 54 and similar article advancers, elastic materials may be used for at least a portion of the article advancer. For example, at least a portion of the article advancer comprises acrylonitrile butadiene styrene, polyoxymethylene, nylon, polypropylene, polyethylene terephthalate, or combinations thereof. In one form, at least a portion of the article advancer is polyoxymethylene or acrylonitrile butadiene styrene. According to one form, the entire article advancer is polyoxymethylene or acrylonitrile butadiene styrene.

Further, the article advancer can have varying thickness. In one form, the article advancer has a thickness in a range of 1 to 3 mm. In accordance with one form, the article advancer has a thickness of approximately 2 mm. According to one form, the article advancer has a generally constant thickness. In other forms, the article advancer has thicker and thinner portions. For example, in one form, the body 62 may have a first thickness while the legs 64,66 have a different thickness that is thinner than the body 62 and vice versa.

As noted previously, the various components described herein may be used in any of the embodiments. For example, the platforms, biasing structures, elastic members, etc. may be used in any of the embodiments.

In some forms, the use of the article advancing assemblies and/or article advancers may cut down on waste compared to conventional dispensing systems that do not include the assemblies and systems described herein. For example, waste may be reduced by at least about 25%, 33%, 40%, or more. In some forms, the average waste per box is approximately 6.5% whereas the average waste per box with an article advancer, such as article advancer 54, is less than 4%. In other forms, the article advancer 54 results in average waste per box less than 3% and in yet other forms, less than 2.8%. The average waste can vary depending on the materials, biasing force, and other properties of the article advancer.

The amount of waste can also be impacted by the type of article being dispensed as well as the container. For example, gloves dispensed from a cardboard box may have less average waste than a different product or when dispensed form a different container. The manner of packing in the container may also impact the amount of waste. However, when used with the same types of articles and containers, the article advancer and article advancing systems provided herein typically can decrease waste.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. An article advancing assembly comprising:

a container defining an interior chamber and a dispensing opening for providing access to the interior chamber; and an article advancer positioned in the interior chamber configured to bias contents of the container towards the dispensing opening, the article advancer having an arcuate body, a first distal end portion, and a second distal end portion opposite the first distal end portion, wherein the first and second distal end portions cooperate with the arcuate body to form opposite peripheral side edges of the article advancer, the opposite peripheral side edges parallel to each other along the first distal end portion, the second distal end portion, and the arcuate body, the article advancer movable between a compressed configuration and a fully dispensed position, in the compressed configuration, a plane extending tangent to an uppermost portion of the arcuate body is positioned a first distance from the first and second distal end portions, in the fully dispensed configuration, the plane extending tangent to the uppermost portion of the arcuate body is positioned a second distance from the first and second distal end portions, the second distance being greater than the first distance, the arcuate body providing a biasing force from the compressed configuration to the fully dispensed configuration, wherein the first distal end portion comprises two first endmost side legs that form first linear portions of the opposite peripheral side edges of the article advancer, the first distal end portion further comprising a first inner sidewall extending between the first endmost side legs and forming a first uninterrupted single U-shaped arch, the first uninterrupted single U-shaped arch including a first uninterrupted end gap formed between opposing first and second inner sidewall portions of the first inner sidewall, the first and second inner sidewall portions having first parallel portions proximate the first endmost side legs and converging to form a first semi-circular central u-shaped portion of the arcuate body, wherein the second distal end portion comprises two second endmost side legs that form second linear portions of the opposite peripheral side edges of the article advancer, the second distal end portion further comprising a second inner sidewall extending between the second endmost side legs and forming a second uninterrupted single U-shaped arch, the second uninterrupted single U-shaped arch including a second uninterrupted end gap formed between opposing first and second inner sidewall portions of the second inner sidewall, the first and second inner sidewall portions of the second inner sidewall having second parallel portions proximate the first endmost side legs and converging to form a second semi-circular central u-shaped portion of the arcuate body, and wherein the first and second linear portions of the opposite peripheral side edges are linked together by and extend in a generally linear manner from curved portions of the opposite peripheral side edges such that the first distal end portion and the second distal end portion are generally planar when the article advancer is in the fully dispensed configuration, the curved portions of the opposite peripheral side edges being formed in the arcuate body.

2. The article advancing assembly of claim 1 wherein at least a portion of the article advancer comprises acrylonitrile butadiene styrene, polyoxymethylene, nylon, polypropylene, polyethylene terephthalate, or combinations thereof.

3. The article advancing assembly of claim 1 wherein the container is a box, a bag, or combinations thereof.

4. The article advancing assembly of claim 1 wherein the container is a box, a bag, or combinations thereof, and wherein the first distal end portion and the second distal end portion are slidable relative to the container.

5. A method of advancing an article in a container, the method comprising the steps of:

providing a container defining an interior chamber and a dispensing opening for providing access to the interior chamber;

providing an article advancer positioned in the interior chamber configured to bias contents of the container towards the dispensing opening, the article advancer having an arcuate body, a first distal end portion, and a second distal end portion opposite the first distal end portion, the first and second distal end portions each cooperating with the arcuate body to form opposite peripheral side edges of the article advancer, the opposite peripheral side edges parallel to each other along the first distal end portion, the second distal end portion, and the arcuate body, the first distal end portion including a first pair of laterally-endmost legs that form first linear portions of the opposite peripheral side edges of the article advancer and having first inner sidewall portions that define a first uninterrupted end gap therebetween, the first inner sidewall portions parallel proximate the first pair of laterally-endmost legs and converging to form a first central semi-circular u-shaped portion of the arcuate body, the second distal end portion including a second pair of laterally-endmost legs that form second linear portions of the opposite peripheral side edges of the article advancer and having second inner sidewall portions that define a second uninterrupted end gap therebetween, the second inner sidewall portions parallel proximate the second pair of laterally-endmost legs and converging to form a second central semi-circular u-shaped portion of the arcuate body opposite the first central u-shaped portion, wherein the first and second linear portions of the opposite peripheral side edges are linked together by and extend in a generally linear manner from curved portions of the opposite peripheral side edges such that the first distal end portion and the second distal end portion are generally planar when the article advancer is in the fully dispensed configuration, the curved portions of the opposite peripheral side edges being formed in the arcuate body, in the compressed configuration, a plane extending tangent to an uppermost portion of the arcuate body is positioned a first distance from the first and second distal end portions, in the fully dispensed configuration, the plane extending tangent to the uppermost portion of the arcuate body is positioned a second distance from the first and second distal end portions, the second distance being greater than the first distance; and compressing the article advancer to the compressed configuration by placing a plurality of articles in the interior chamber on the article advancer, wherein compressing the article advancer causes the first and second distal end portions to slide relative to the container.

6. The method of claim 5 further comprising the step of removing at least one of the plurality of articles to permit the article advancer to move towards the fully dispensed configuration.

* * * * *